US012312208B2

(12) United States Patent
Blanchard et al.

(10) Patent No.: US 12,312,208 B2
(45) Date of Patent: May 27, 2025

(54) HOSE REEL

(71) Applicant: Marshall Excelsior Co., Marshall, MI (US)

(72) Inventors: Frederick W. Blanchard, Caldwell, ID (US); Aaron Zuck, Homer, MI (US)

(73) Assignee: Marshall Excelsior Co., Marshall, MI (US)

( * ) Notice: Subject to any disclaimer, the term of this patent is extended or adjusted under 35 U.S.C. 154(b) by 633 days.

(21) Appl. No.: 17/450,587

(22) Filed: Oct. 12, 2021

(65) Prior Publication Data

US 2022/0112047 A1 Apr. 14, 2022

Related U.S. Application Data

(60) Provisional application No. 63/090,787, filed on Oct. 13, 2020.

(51) Int. Cl.
*B65H 75/44* (2006.01)

(52) U.S. Cl.
CPC ..... *B65H 75/4407* (2013.01); *B65H 75/4471* (2013.01); *B65H 75/4486* (2013.01); *B65H 2701/33* (2013.01)

(58) Field of Classification Search
CPC ..... B65H 75/4402; B65H 75/4405; B65H 75/4407
See application file for complete search history.

(56) References Cited

U.S. PATENT DOCUMENTS

| | | | | |
|---|---|---|---|---|
| 2,301,208 | A * | 11/1942 | Gear | B65H 75/4486 242/390.8 |
| 2,595,655 | A * | 5/1952 | Hannay | B65H 75/38 137/355.2 |
| 3,397,850 | A | 8/1968 | Anderson | |
| 3,716,200 | A | 2/1973 | Sartori | |
| 4,513,772 | A | 4/1985 | Fisher | |
| 4,540,017 | A | 9/1985 | Prange | |
| 5,495,995 | A | 3/1996 | Dominique et al. | |
| 6,877,687 | B2 | 4/2005 | Moon et al. | |
| 7,350,736 | B2 | 4/2008 | Caamano et al. | |
| 7,419,137 | B2 | 9/2008 | Boon | |
| 7,503,338 | B2 | 3/2009 | Harrington et al. | |

(Continued)

FOREIGN PATENT DOCUMENTS

KR 2019-0056028 * 5/2019

OTHER PUBLICATIONS

English Translation of KR 2019-0056028 (Year: 2019).*

*Primary Examiner* — William A. Rivera
(74) *Attorney, Agent, or Firm* — Neal, Gerber & Eisenberg LLP

(57) ABSTRACT

A hose reel includes a frame, a spool supported on the frame for rotation relative to the frame, a motor supported on the frame to provide motive power to the spool, a level wind device supported on the frame to guide a hose during winding and unwinding; the level wind device being selectively linked to the rotation of the spool and including a disengagement clutch for selectively decoupling the operation of the level wind device from the rotation of the spool. The hose reel may be selectively operated to provide a power-out assist during unwinding that provides a power level to the motor less than a threshold power necessary to drive the spool in the unwinding direction.

20 Claims, 21 Drawing Sheets

(56) References Cited

U.S. PATENT DOCUMENTS

| | | | | |
|---|---|---|---|---|
| 7,568,650 | B2 | 8/2009 | Barker | |
| 7,688,010 | B2 | 3/2010 | Caamano et al. | |
| 7,692,393 | B2 | 4/2010 | Caamano et al. | |
| 8,132,592 | B2 | 3/2012 | Harrington et al. | |
| 8,336,800 | B1 * | 12/2012 | Lopez | B65H 75/4407 137/355.27 |
| 8,695,912 | B2 | 4/2014 | Tracey et al. | |
| 8,746,605 | B2 | 6/2014 | Tracey et al. | |
| 9,067,759 | B2 | 6/2015 | Tracey et al. | |
| 9,533,856 | B2 | 1/2017 | Spelich et al. | |
| 9,663,322 | B2 | 5/2017 | Tracey et al. | |
| 9,738,488 | B2 | 8/2017 | Kopp et al. | |
| 9,771,239 | B2 | 9/2017 | Tracey et al. | |
| 10,259,680 | B2 | 4/2019 | Tsukui et al. | |
| 10,287,130 | B2 | 5/2019 | Morgan et al. | |
| 10,309,171 | B1 | 6/2019 | He et al. | |
| 10,329,858 | B1 | 6/2019 | He et al. | |
| 10,513,412 | B2 | 12/2019 | Summer et al. | |
| 10,556,772 | B2 | 2/2020 | Tracey et al. | |
| 10,666,026 | B1 | 5/2020 | Hrbacek et al. | |
| 10,737,903 | B2 | 8/2020 | Poutiainen | |
| 10,745,984 | B2 | 8/2020 | Dion | |
| 10,882,716 | B1 | 1/2021 | Smith | |
| 2005/0087644 | A1 | 4/2005 | Kim | |
| 2007/0272787 | A1 * | 11/2007 | Jian | B65H 75/4407 242/395 |
| 2009/0014571 | A1 | 1/2009 | Belford | |
| 2010/0072320 | A1 | 3/2010 | Bartov | |
| 2010/0294872 | A1 * | 11/2010 | Wang | B65H 75/4486 242/390.8 |
| 2016/0199889 | A1 * | 7/2016 | Larsen | B65H 75/4484 134/18 |
| 2017/0022026 | A1 | 1/2017 | Chapa et al. | |
| 2018/0370755 | A1 | 12/2018 | Zimmerman | |
| 2019/0161201 | A1 * | 5/2019 | Espinosa-Sanchez | B65H 75/4478 |
| 2019/0237957 | A1 * | 8/2019 | Kiely | H02G 11/02 |
| 2020/0223656 | A1 | 7/2020 | Tracey et al. | |
| 2022/0166203 | A1 * | 5/2022 | Theib | B65H 75/4407 |
| 2023/0078411 | A1 * | 3/2023 | Beyersdorff | B66D 1/28 242/397.3 |
| 2023/0159300 | A1 * | 5/2023 | Tu | B65H 75/4481 242/389 |

* cited by examiner

FIG. 21
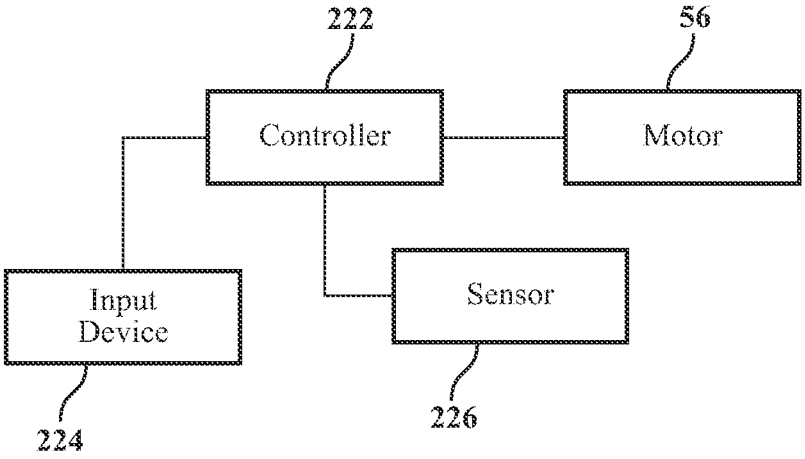
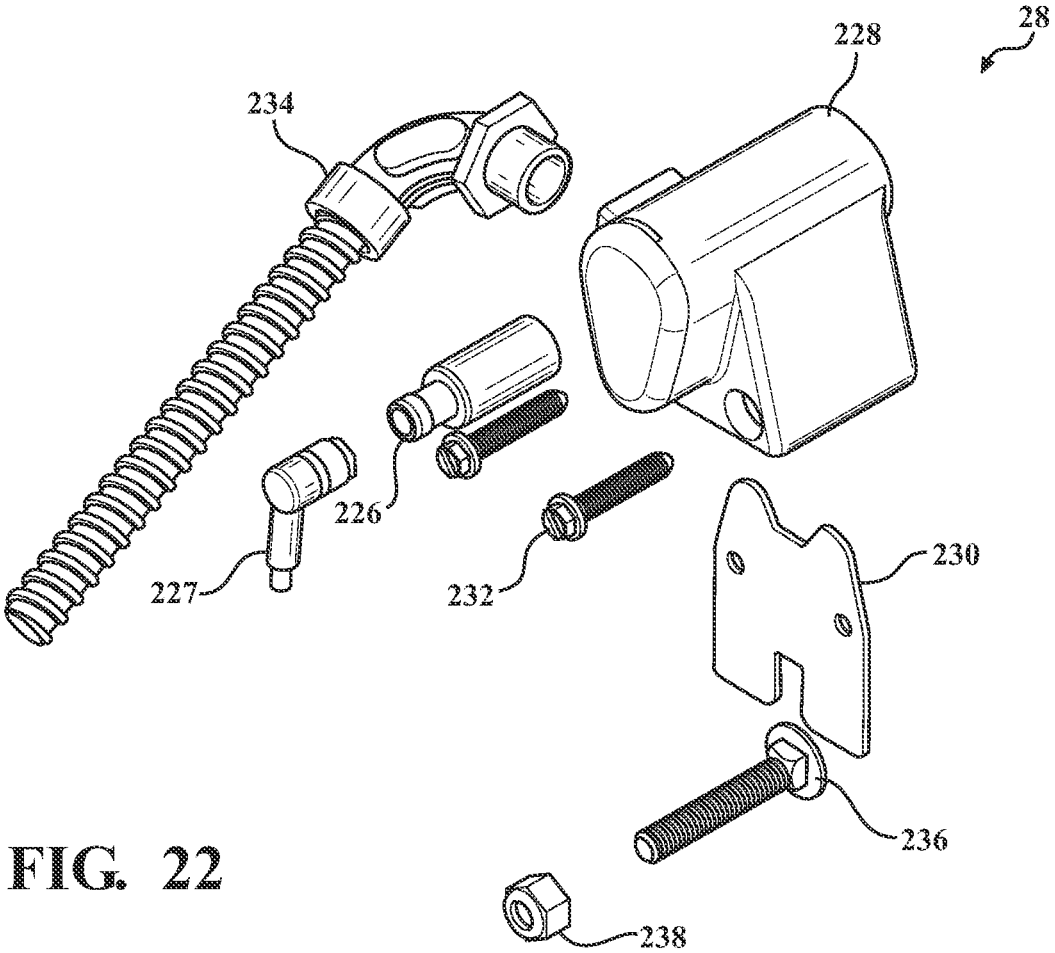
FIG. 22

HOSE REEL

CROSS-REFERENCE TO RELATED APPLICATIONS

The present application claims the priority of provisional application Ser. No. 63/090,787, filed Oct. 13, 2020, the entirety of which is incorporated by reference herein.

BACKGROUND

1. Field of the Invention

The present disclosure relates to a hose reel for storing and transporting a hose, and more specifically to a power-assisted hose reel with level-winding guidance.

2. Description of the Related Art

Hoses are useful for the transfer of liquids, such as liquefied petroleum gas or other refined fuel products, to and from vehicles designed to carry liquids or gases on roads. To store and transport hoses, transport vehicles may be equipped with hose reels. Hose reels typically include a spool, drum, or similar rotatable component around which the hose is wound for compact storage and transportation on the vehicle. The spool may be manually operated by an operator rotating the spool to wind or unwind the hose from the hose reel. Alternatively, the hose reel may include powered operation with a motor driving the rotation of the spool to wind or unwind the hose from the reel.

Conventional hose reels may have one or more of a number of disadvantages. A motor-driven hose reel may operate at a fixed motor speed that is faster than what is safe or desirable. Inertia from a high rate of speed may cause a significant amount of hose travel after power to the motor is discontinued. The linear speed of the hose may also change as the effective diameter of the reel changes as layers of hose are added or removed on the spool. When a motor is used to drive the reel in the unwind direction, the hose may bind up in the spool if the unwound hose is not properly cleared from around the spool. Even if cleared from the spool, the hose may pile up as it is unwound, potentially causing damage to the hose, or creating unsafe trip hazards to workers in the area.

Where a motor is employed to drive the spool, conventional hose reels may be driven by a chain extending between a sprocket provided at the motor and a sprocket provided at the spool. These conventional chain drives have disadvantages in hose reel applications. The chains wear and may stretch or become loose, which can allow the chain to come off of the sprocket. Chains are typically assembled with rollers that turn on pins spanning between chain links, which may corrode and introduce significant friction and resistance to the motor.

Alternatively, powered hose reels may be driven with a single-piece drive gear mounted to the spool. Single-piece gears may be as large as the spool itself and may require disconnecting a liquid line at an inlet swivel to service or replace the gear. Service or replacement of the entire gear may be required if even a single tooth is damaged. Another disadvantage is the high cost of manufacturing single-piece gears, particularly large ring gears, due to poor material utilization.

Conventional hose reels often use threaded fasteners, such as nuts and bolts, to hold assemblies together. Access for fastener installation or drive tools can be limited or obstructed due to the compact design from space limitations for installing on vehicles. This makes it difficult to assemble or service. Assembly or service of hose reels may also be challenging as hose reels typically require heavy components, such as a drive motor or spool, to be held in position while fasteners are aligned, installed, and tightened. Therefore, it is difficult to perform assembly or service tasks safely and efficiently.

Hose reels may be provided with a stationary or moving guide to automate the process of evenly distributing the wraps of the hose into levels during winding of the hose onto the spool. The guide may aid in packing the wraps of the hose on the spool to reduce the size of the reel needed to hold a given length of hose as compared with a hose reel lacking a guide where the wraps are not efficiently placed. The guide arranged for movement relative to the spool may be linked in operation to the spool so that rotation of the spool causes a corresponding movement of the level wind device. The linked movement of the guide device to the spool can nevertheless be a disadvantage, for example, when loading or unloading the hose, or by eliminating the ability to manually adjust the rotational position of the spool relative to the position of the guide. The guide may also include rollers or guide surfaces that are limited in the ability to align the hose to the spool when the hose is wound or unwound in any direction other than directly outward from the spool. Moreover, the rollers or guide surfaces may cause friction that increases the force required to wind or unwind the hose and that may cause wear and damage to the material of the hose. Conventional guide may also cause the hose to bend or kink undesirably.

Therefore, it is desirable to provide a hose reel with improved motor operation, drive coupling, and level wind guidance that addresses the above described disadvantages, and other shortcomings of conventional designs.

SUMMARY

Accordingly, an improved hose reel is provided. The hose reel of the present application includes a frame. The frame may include a motor mount. The motor mount may include a plurality of keyhole slots for receiving a head of a fastener. The motor mount may further include a stud retainer. The stud retainer includes a biasing arm covering a backside of each of the plurality of keyhole slots.

The hose reel may include a spool supported on the frame for rotation relative to the frame. The spool may include a drum extending between a first reel end and a second reel end. The drum may define an interior. The spool may include an inlet body having a first flange and a second flange. The first flange may be disposed adjacent the first reel end outside the drum interior. The second flange may be disposed within the interior of the drum. The inlet body may extend through the first reel end. The spool may include a riser. The riser may have a riser flange at the first end for connecting to a second flange of the inlet body in the interior of the drum. The riser may have a hose connection at a second end, opposite the first end, for connecting to a hose. The riser may extend obliquely from the interior of the drum, wherein the second end of the riser, outside of the drum interior is disposed nearer to the first reel end than the first end of the riser disposed in the drum interior.

The hose reel may include a drum having a cutout for accessing an interior of the drum. The riser may extend from the interior of the drum through the cutout. The cutout may further define a protective lobe that extends between at least a portion of the riser and the interior of the drum.

The hose reel may include a level wind device support on the frame. The level wind device may include a carriage assembly for back-and-forth translation. The translation of the carriage assembly is selectively linked to the rotation of the spool via a gear box. The gear box may include a disengagement clutch for selectively decoupling the translation of the carriage assembly from the rotation of the spool. The level wind device may include an alignment guide. The alignment guide may include a roller frame. The alignment guide may include a roller matrix. The alignment guide may include a gimbal guide in combination with the alignment guide. The gimbal guide may be selectively positionable between a storage position and a deployed position. The gimbal roller guide may include a clevis supported on a carriage lockable in the deployed position. The clevis may be lockable in the storage position. The clevis may support a yoke for rotation about a first axis. The yoke may support a fork rotatable about a second axis substantially perpendicular to the first axis. Substantially perpendicular refers to the reality of manufacturing tolerances that may fail to achieve ideal geometrical or mathematical perfection. For example, substantially perpendicular means perpendicular with up to 3° of deviation. The fork may support a roller for guiding the hose while winding or unwinding in directions oblique or perpendicular to the arrangement of the reel assembly.

A hose reel system may comprise a frame, a spool supported on the frame for rotation relative to the frame, a motor supported on the frame to drive a rotation of the spool; a sensor supported on the frame and arranged to generate a signal upon rotation of the spool; and a controller in communication with the sensor and the motor. The controller may comprise a processor and a memory device storing instructions that when executed cause the controller to perform a power-out assist. Performing a power-out assist includes receiving, at the controller, a power-out assist command in a first step. In another step, the controller provides a first current level to the motor. The first current level may be less than a threshold current level necessary to overcome a static friction of the motor and spool. In another step, the controller may detect rotation of the spool based on the signal generated by the sensor. The controller, in response to detecting rotation of the spool, may provide a second current level to the motor. The second current level may be less than a threshold current level necessary to overcome a dynamic friction of the motor and spool. In a further step, the controller may detect a rotation stop of the spool based on an absence of the signal generated by the sensor. In response to detecting a rotation stop of the spool the controller may terminate the current to the motor.

The hose reel system may be operable to provide a power-out assist where the user does not maintain a continuous input to the controller. The controller may receive a momentary power-out command. The controller may disable motor braking and indicate successful activation of the power-out assist operation by causing a momentary actuation of the motor. If the controller does not receive a sensor signal to indicate hose movement within a time window following receipt of the command, the operation cancels and motor braking is applied to the spool. If the controller does receive a sensor signal indicating hose movement, the controller will power the motor up to a drive level and will continue to monitor and store the hose speed over one or more spool revolutions. Monitoring the hose speed includes detecting relative changes over time in the hose speed. The controller may act based on detecting hose speed decreasing beyond a threshold amount. The threshold amount may be a decrease of greater than or equal to 50% of the previously measured hose speed, or may be a decrease to less than or equal to 1 mile per hour. Upon detecting a decrease in hose speed beyond the threshold, the controller may deactivate the power-out assist operation and apply motor braking. The power-out assist operation may be reactivated by the controller if the controller receives a momentary reel-out command within a time window following deactivation of the power-out assist operation.

In presenting the written description, certain aspects, advantages and novel features have been mentioned. It is understood that not all aspects, advantages or features may be practiced in any particular instance or described example. Thus, the hose reel may be embodied or carried out in a manner that includes one aspect, advantage, or feature, or various groups thereof as taught herein without necessarily achieving others as may be taught or suggested herein.

BRIEF DESCRIPTION OF THE DRAWINGS

Advantages of the present disclosure will be readily appreciated, as the same becomes better understood by reference to the following detailed description, when considered in connection with the accompanying drawings, wherein:

FIG. 21 shows a schematic of a control arrangement for a hose reel assembly.

FIG. 22 shows an exploded view of the components of a sensor assembly.

DETAILED DESCRIPTION

Figure 1:
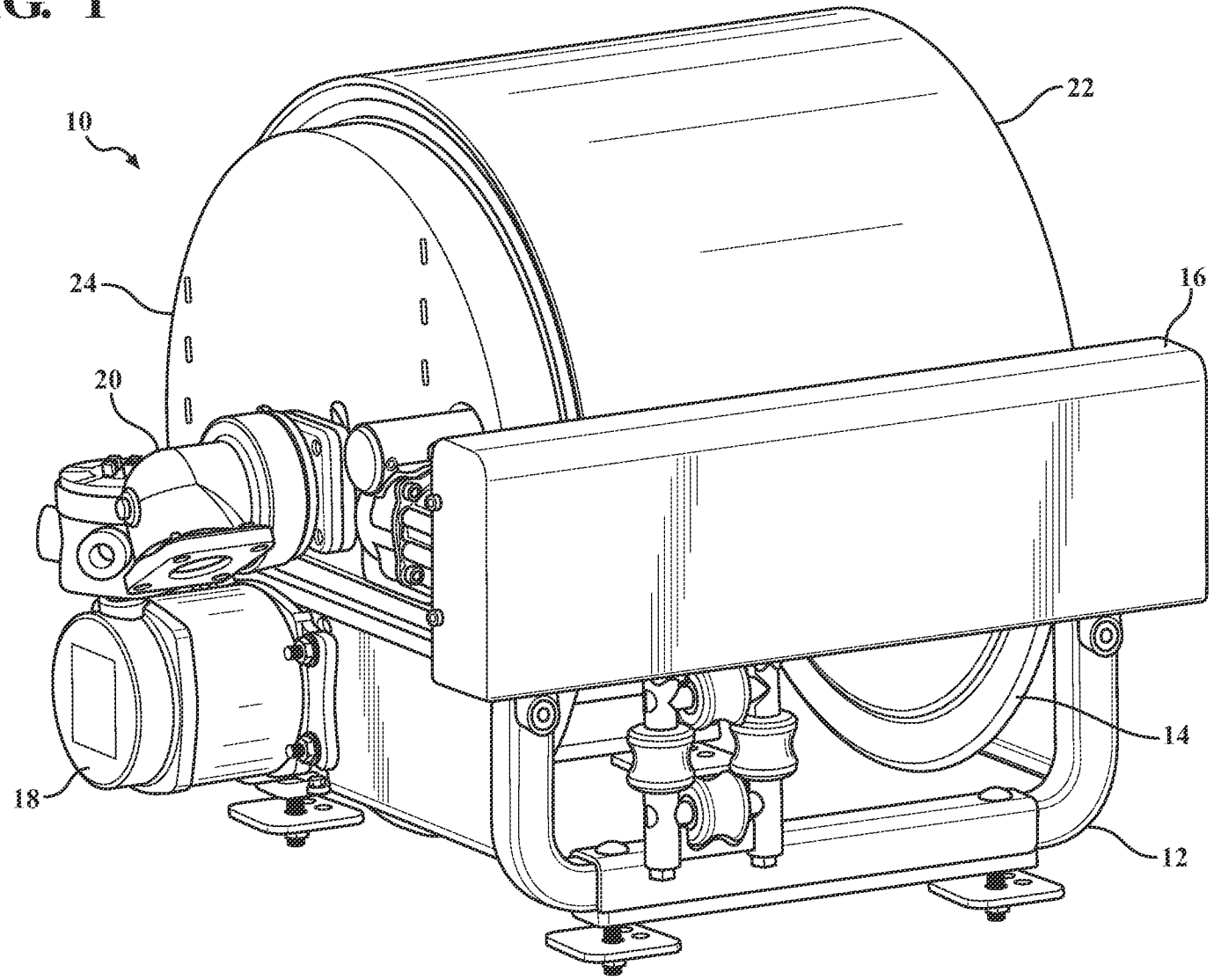
FIG. 1 shows a perspective view of a hose reel assembly.

Referring to the Figures, wherein like numerals indicate like or corresponding parts throughout the several views, a hose reel is generally shown at 10 as a hose reel assembly for the storage or transportation of a hose or similar elongated material (not shown in FIG. 1) supportable on a vehicle or other installation. The hose reel assembly 10 includes a frame assembly 12. The frame assembly 12 alternatively may be referred to as simply the frame. Supported on the frame assembly 12 for rotational movement is a spool assembly 14. The spool assembly 14 alternatively may be referred to as simply the spool. A level wind device 16 is provided to guide the hose as it is wound or unwound from the spool assembly 14. A motor assembly 18 engages with and drives the spool assembly 14. The spool assembly 14 may be arranged to drive the level wind device 16 for coordinated motion therewith. A swivel joint 20 provides an external access point for the fluid pathway leading to the hose housed on the hose reel. A pipe or other fluid source (not shown) leading from the tank supported on the vehicle (not shown) or otherwise provided in fluid communication can be connected to the swivel joint 20 for delivering the stored fluid through the hose. A spool cover 22 encloses the spool assembly to cover and protect the hose during storage or transportation. A guard assembly 24 encloses an end of the hose reel assembly 10 to protect the mechanical engagement between the motor assembly 18, the spool assembly 14 and the level wind device 16.

Figure 2:
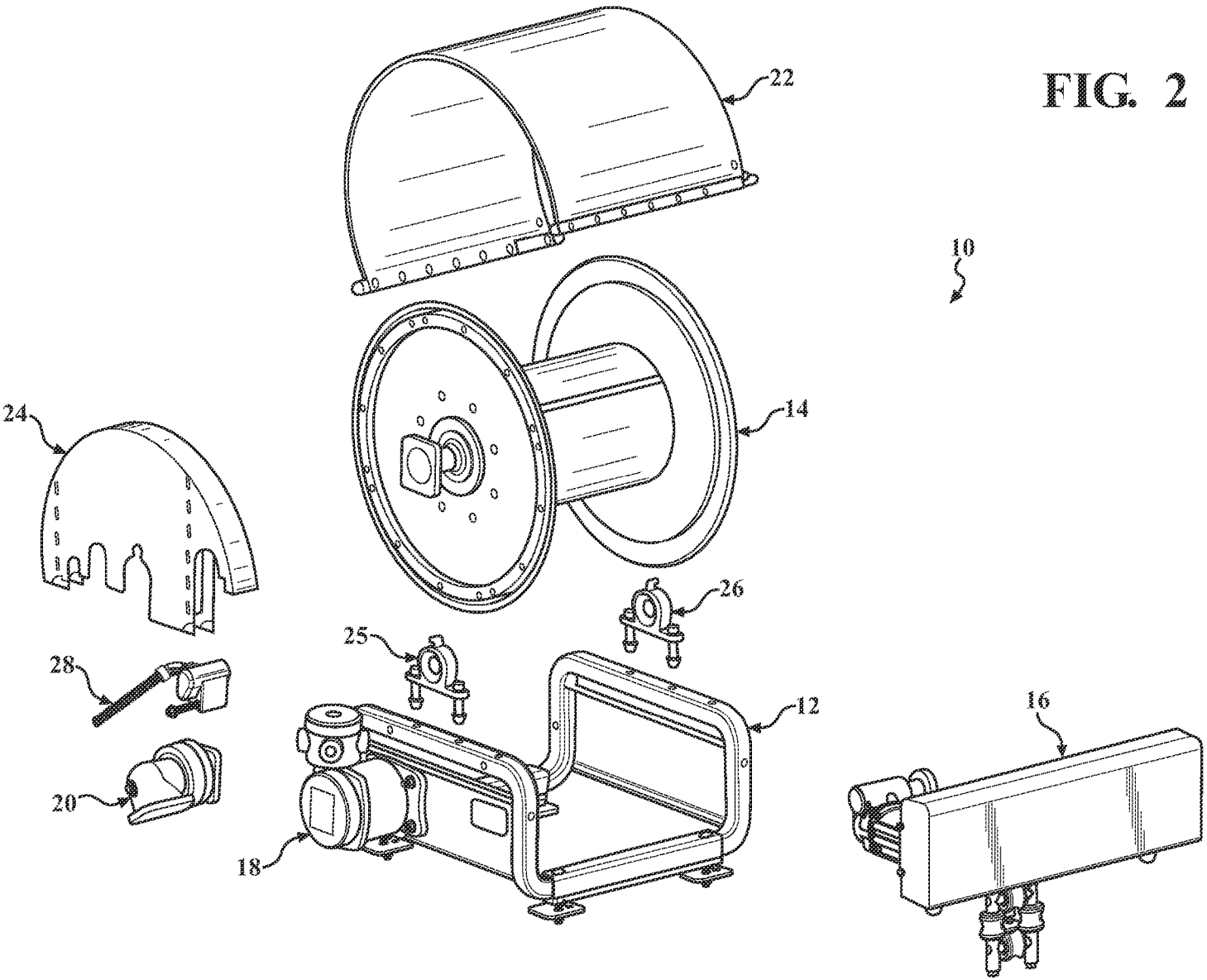
FIG. 2 shows an exploded view of the components of the hose reel assembly of claim 1.

FIG. 2 is an exploded view of the component assemblies of the hose reel assembly 10 shown in FIG. 1. Bearing assemblies 25, 26 support the spool assembly 14 on the frame assembly 12. A sensor assembly 28 is arranged to detect information about the operation of the hose reel assembly 10 and is in data communication with a controller (not shown in FIG. 2). Each of these component assemblies will be described in more detail below in an illustrative manner, which description is not intended to be limiting.

Figure 3:
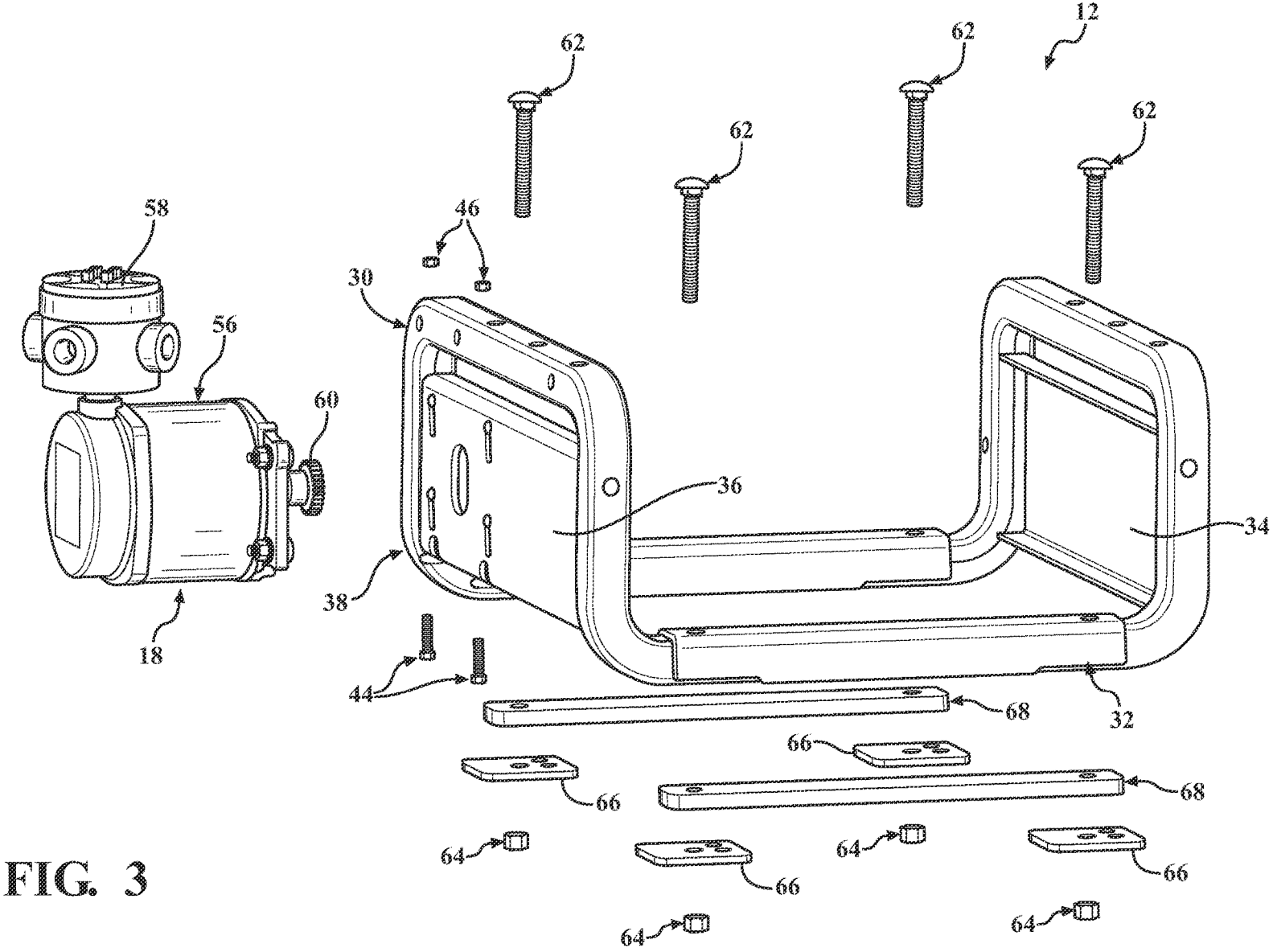
FIG. 3 shows an exploded view of the components of the frame assembly.

The frame assembly 12 is illustrated as an exploded view in FIG. 3. The frame assembly 12 includes a structural frame 30. The frame 30 can include a bent metal tube frame in one or multiple sections that provides the structural support for the hose reel assembly 10. The frame 30 can define a base 32 and side walls 34, 36. The frame 30 may be assembled from a combination of plate and tube sections using one or more of welds, threaded fasteners, adhesives or combinations thereof.

Side wall 36 includes a motor mount 38 for receiving and supporting the motor assembly 18. Illustrated in more detail in FIG. 4, the motor mount 38 may include a number of keyhole slots 40 in the side wall 36. For example, the motor mount 38 may include four keyhole slots 40. Each keyhole slot 40 can receive the head of a threaded fastener or stud 42 to mount the motor assembly 18. The threaded fastener 42 may be a carriage bolt or round-headed square-neck bolt with geometry complementary to the keyhole slot 40 so that once inserted, the threaded fastener 42 resists rotation in the keyhole slot 40. The number and placement of the keyhole slots may depend on the geometry of the motor assembly 18 to be mounted in engagement with the spool assembly 14. Vertical adjustment screws 44 may also be provided to properly position the motor assembly 18 relative to the spool assembly. The vertical adjustment screws 44 may be secured through a threaded hole of a bracket extending from the side wall 36 at the motor mount 38. The vertical adjustment screws 44 may be selectively anchored in place with a jam nut 46.

Figure 5:
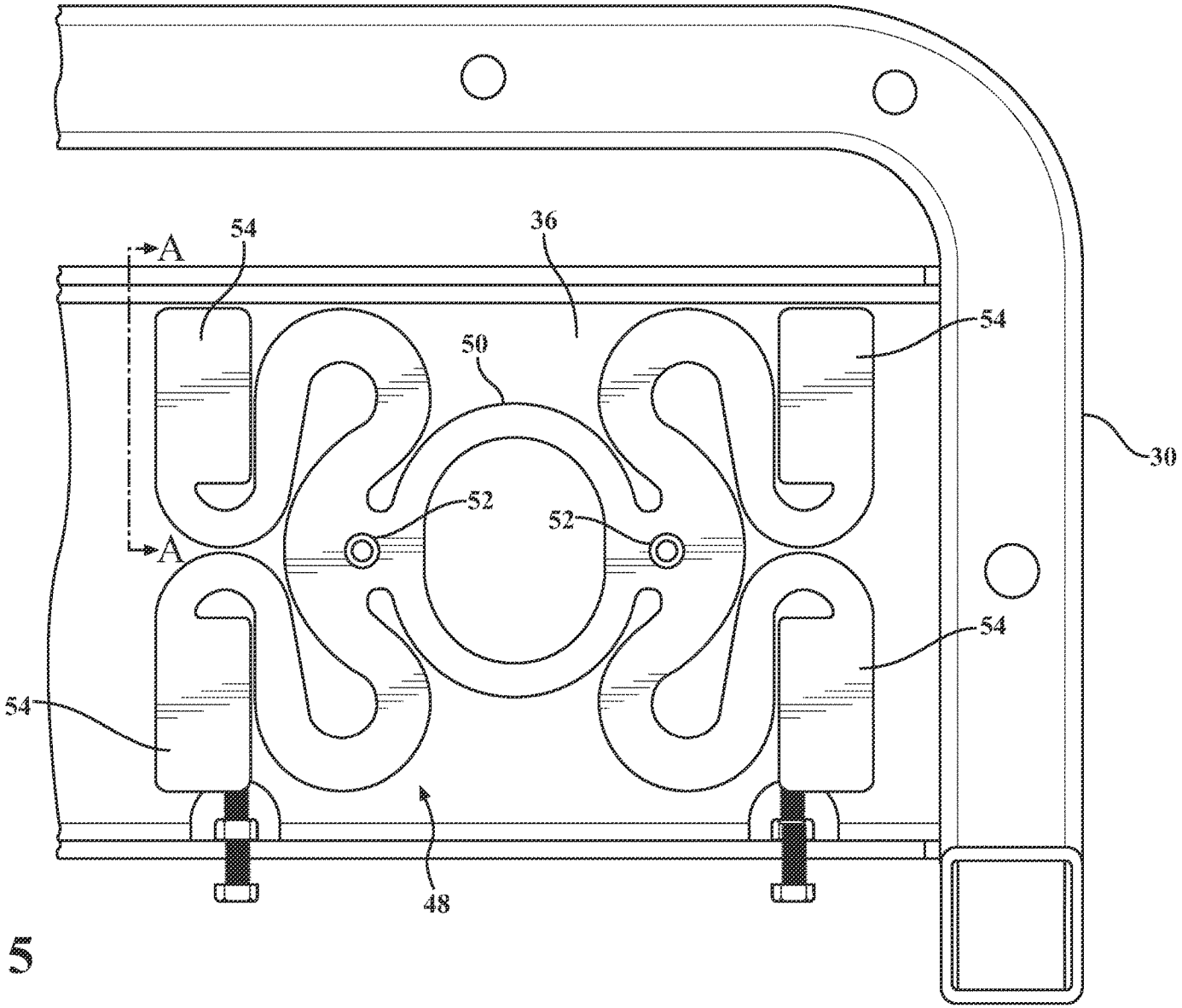
FIG. 5 shows a reverse view of the frame assembly portion shown in FIG. 4.

The threaded fasteners 42 are held in place in the keyhole slots 40 with a spring tempered stud retainer 48. The stud retainer 48 is illustrated in FIG. 5, which shows the reverse view of the motor mount 38 portion of the side wall 36. Access for fastener installation or driving tools can be limited or obstructed in conventional designs, which makes it difficult to complete tasks during assembly or service. The stud retainer 48 retains fasteners in place without requiring direct manipulation during assembly or service while providing ease of access to remove or replace the fasteners should the threads become damaged or where an alternative thread size or type is required. The stud retainer 48 may be formed from a thin-walled metal plate, such as a steel plate. The stud retainer 48 may include a central mounting portion 50 surrounding the pass-through opening in the side wall 36 through which the motor assembly 18 extends to engage with the spool assembly 14. The central mounting portion 50 is illustrated to include fasteners 52 securing the stud retainer to the side wall 36. The side wall 36 may include threaded holes to receive the fasteners 52. Alternatively, the stud retainer 48 may be secured to the side wall 36 using clips, rivets, by welding, or other suitable means.

Extending from the central mounting portion 50, biasing spring arms 54 are arranged to cover a back side of the keyhole slots 40. As the head of a fastener 42 is inserted into the keyhole slot 40 it deflects the spring arm 54 away from the side wall 36. The resiliency of the stud retainer 48 spring arm 54 biases against the fastener 42 to hold the square neck portion of the fastener 42 in the keyhole slot 40 and resist rotation or backing out during mounting of the motor assembly 18 to the motor mount 38. This eliminates the need to access a back side of the fastener 42 during installation or service.

Figure 4:
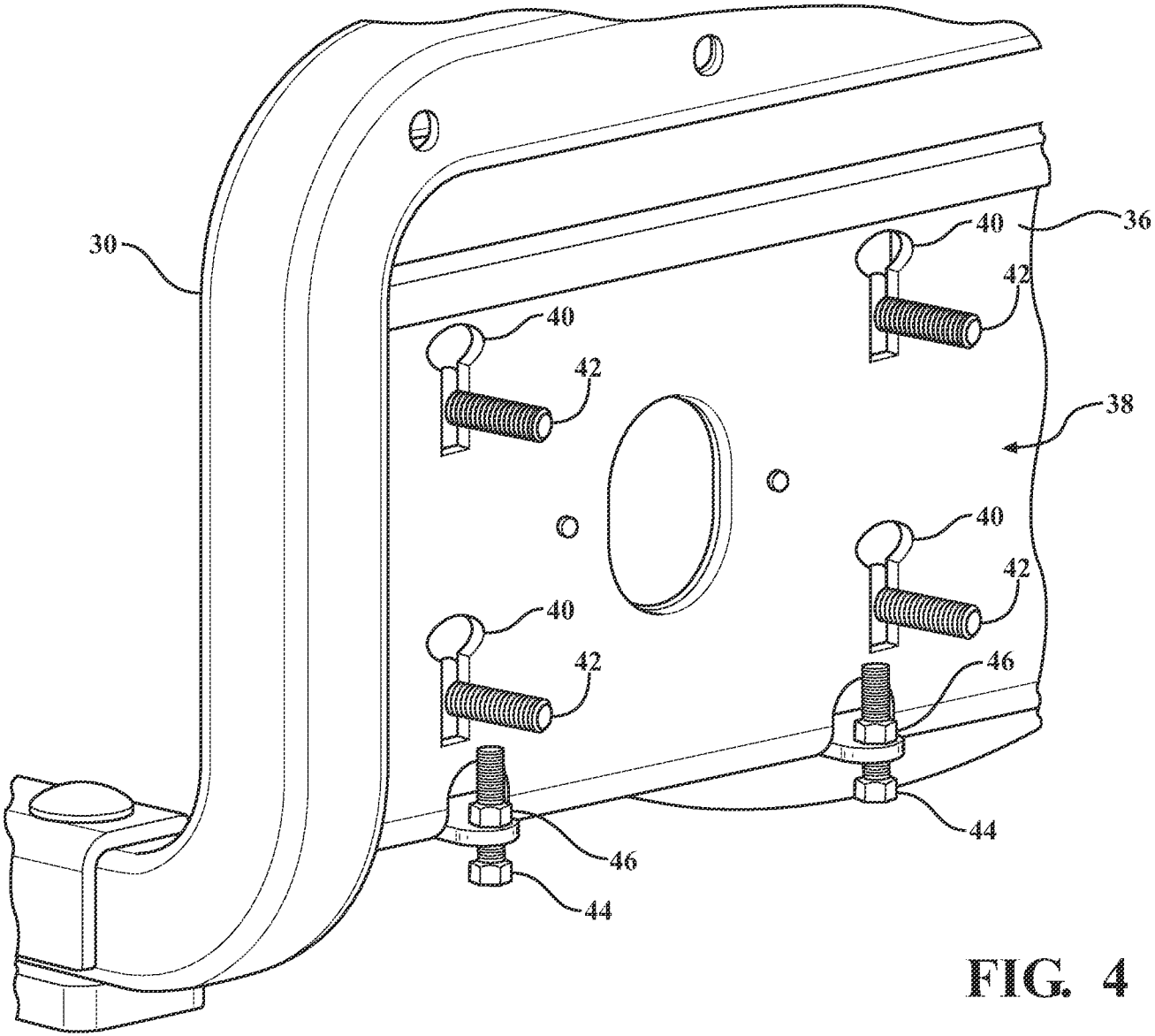
FIG. 4 shows a portion of a frame assembly including a motor mount.
Figure 7:
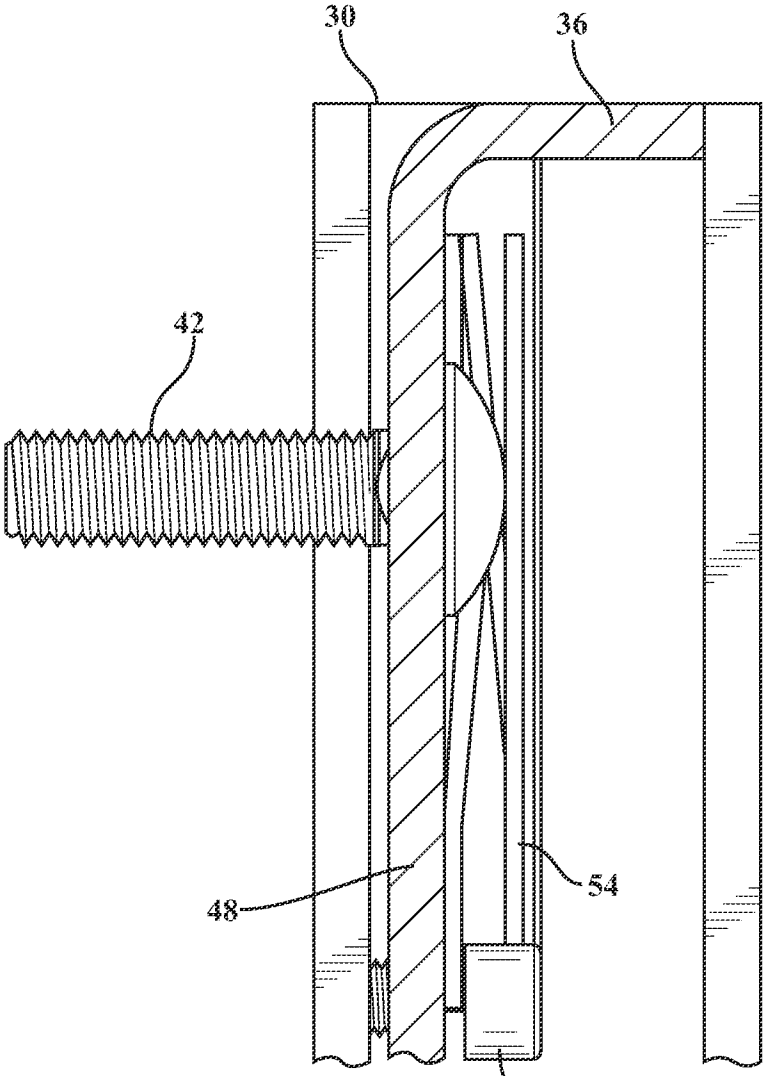
FIG. 7 shows a fastener retained by the stud retainer of FIG. 6 from a side view perspective through the section line A-A shown in FIG. 5.
Figure 6:
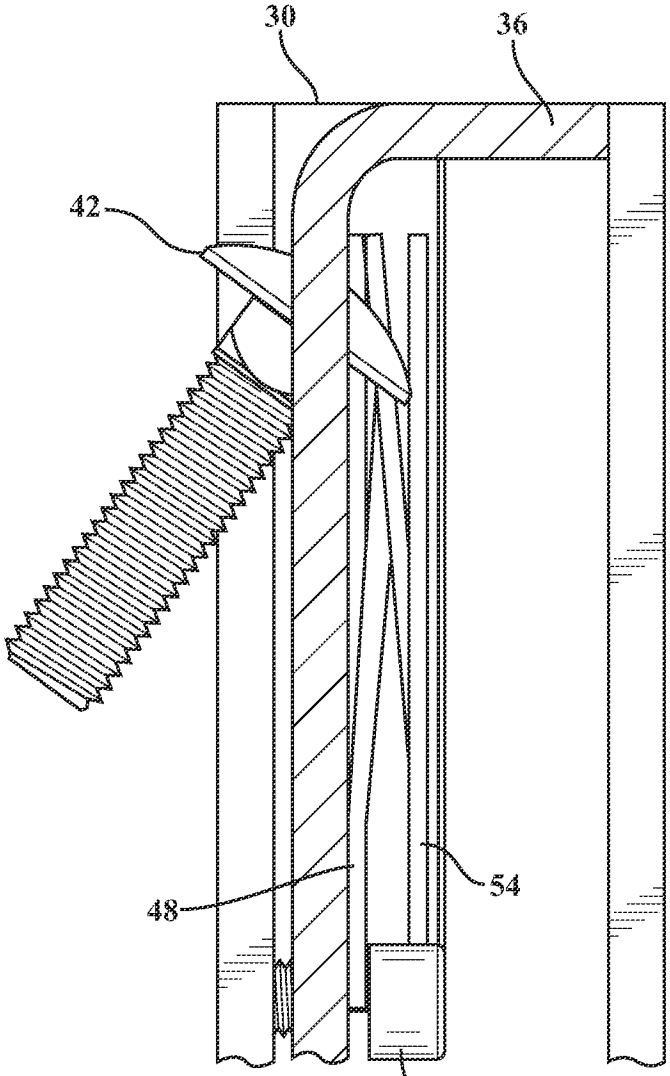
FIG. 6 shows an installation of a fastener to a stud retainer from a side view perspective through the section line A-A shown in FIG. 5.

FIGS. 6 and 7 illustrate the operation of the stud retainer 48 retaining the fastener 42. FIG. 6 shows the point where the fastener 42 is inserted through the keyhole slot 40. FIG. 7 shows the spring arm 54 acting against the fastener 42 to retain the fasten 42 in the keyhole slot 40. As best shown in FIG. 5, the spring arm 54 follows a serpentine path from the central mounting portion 50 so that the biasing force applied to the fastener 40 remains substantially constant regardless whether the fastener 42 is positioned at an upper adjustment limit along the keyhole slot 40, as illustrated in FIG. 7, at a central adjustment along the keyhole slot 40, as illustrated in FIG. 4, or at a lower adjustment limit along the keyhole slot 40. Each spring arm 54 interacts with each fastener 42 independently so that each fastener 42 can be installed and adjusted independently and without potentially displacing any other fastener 42 during the installation process. The length of the spring arm 54 along the serpentine path allows the spring arm 54 to accommodate a greater deflection that may occur during fastener 42 or motor assembly 18 installation without plastically deforming or diminishing the biasing force applied by the spring arm 54.

The stud retainer 48 facilitates an efficient assembly of the motor assembly 18 to the frame assembly 12. The motor assembly 18 is illustrated in FIG. 3 and assembles to the frame 30 at the motor mount 38. The motor assembly 18 includes an electric motor 56. The motor 56 may be specially adapted for application in hazardous locations, such as installed on a liquid transport truck or tanker truck. The motor 56 may be a permanent magnet, direct current (DC), brush motor with its operation controlled through pulse width modulation (PWM). The motor 56 may have a rotor with windings that are connected through a commutator to a system of non-rotating brushes that are electrically connected to motor leads (not shown), for example at junction box 58. When current is applied through the leads, a magnetic field is created in the rotor windings that interacts with the magnetic field created by the non-rotating permanent magnets in the motor housing, causing it to rotate. The interaction between the resulting magnetic fields determines the characteristics of the motor's 56 speed-torque-current performance curves. Reversing the polarity of the power to the motor reverses the direction of rotation. The rotor drives an output shaft that passes through the motor housing. The control and operation of the motor is described in greater detail below.

A motor gear 60 is supported on the output shaft for rotational movement therewith and to transmit the movement generated by the motor 56. The motor gear may be secured to the output shaft with a woodruff key, a set screw, a threaded interface between the shaft and gear 60, corresponding splines and grooves, or other suitable means. Once the motor assembly 18 is installed to the frame assembly 12, the motor gear 60 extends inward of the frame to interface with the spool assembly 14.

The frame assembly 12 may secure the hose reel assembly 10 to a vehicle or other installation using fasteners 62, 64 and backing plates 66. The fasteners 62, 64 sandwich the frame 30 to a structural component (not shown) to retain the hose reel assembly 10 to the installation location. Dielectric mounts 68 may electrically isolate the hose reel assembly 10 from installation location, including, for example, the vehicle frame.

Figures 8, 8A:
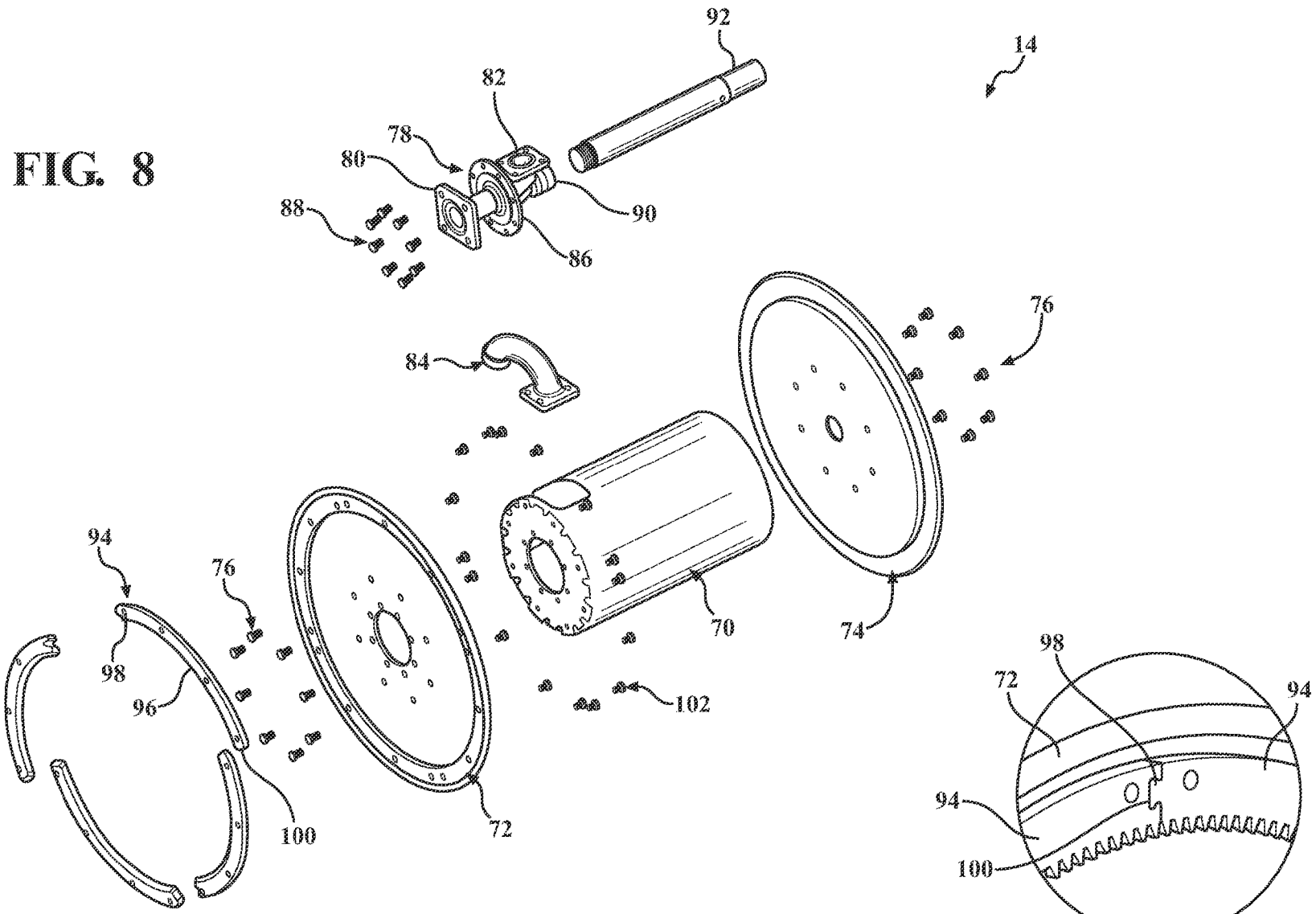
FIG. 8 shows an exploded view of the components of the spool assembly.
FIG. 8A shows a detailed view of a portion of the spool assembly.

Referring now to FIG. 8, the spool assembly 14 is shown in an exploded view to illustrate exemplary components making up the illustrated spool assembly 14. The spool assembly 14 includes the rotatable drum 70 around which the hose wraps for storage and transportation. The coils of hose disposed around the drum 70 are limited by first and second reel ends 72, 74. The drum 70 and reel ends 72, 74 may be formed from metal plate material or any other material suitable for the intended application of the hose reel assembly. The first and second reel ends 72, 74 may be secured to the drum 70 via fasteners 76. In other alternatives, the first and second reel ends 72, 74 may be secured to the drum 70 via welding, rivets, or other suitable means.

To facilitate the fluid communication from a fluid source, such as a tank, (not shown) connected to the swivel joint 20 to a hose provided on the reel, an inlet body 78 is provided. The inlet body 78 may be formed via casting, machining or other suitable means. The inlet body 78 includes a first flange 80 for joining to the swivel joint 20 to form a first fluid tight connection. At an opposite end of the fluid pathway through the inlet body 78, a second flange 82 is provided for joining to riser 84 to form a second fluid tight connection.

The inlet body 78 may include a mounting surface 86 for securing the inlet body 78 to the drum 70, for example, via fasteners 88. The inlet body 78 may also include a pocket 90 having internal threads for receiving and securing an axle 92. The axle 92 extends through second reel end 74 to be received in bearing assembly 26 for free rotation. The spool assembly 14 is supported for rotation at its opposite end by the bearing assembly 25 via the inlet body 78 which is received in the bearing assembly 25.

The motor assembly 18 interfaces with the spool assembly 14 via the motor gear 60 and interlocking gear segments 94 mounted on the first reel end 72. The interlocking gear segments 94 include an internal surface 96 that once installed define an internal-tooth ring gear for engaging with the external teeth of the motor gear 60. Each segment 94 includes a first and a second interlocking feature 98, 100 that engages with the adjacent segments 94. The interlocking features 98, 100 allow the individual segments 94 to communicate the force received from the motor gear 60 to adjacent segments, thereby reducing the load and wear on a single segment 94 as compared to non-interlocked gear segments. The interlocking features 98, 100 are illustrated in greater detail in FIG. 8A, which shows two adjacent gear segments 94 interlocked and assembled to the first reel end 72.

The interlocking gear segments 94 can be nested during manufacturing to improve material utilization and reduce scrap and cost for profile cutting operations such as laser or water jet cutting or milling. Unlike a single piece gear that can be large, heavy and difficult to position during assembly or service, the gear segments 94 are lighter and easier to individually align and install to the reel end 72, for example, via fasteners 102. Should one gear segment 94 become damaged or worn, only the affected segment can be serviced or replaced, without replacing an entire gear and without disconnecting the liquid line from the hose reel.

FIG. 8 illustrates the spool assembly 14 having four gear segments 94 with four fasteners 102 per each gear segment 94, but this is not intended to be limiting. Alternatively, two, three or other suitable number of gear segments may be employed to complete the internal tooth ring gear formed along the reel end 72. Likewise, two, three or other number of fasteners 102 may be utilized per each gear segments 94 to secure to the reel end 72. Further alternatively, the gear segments 94 may be removably secured to the reel end 72 through other suitable means, such as through clips, pins, or otherwise.

Figure 9:
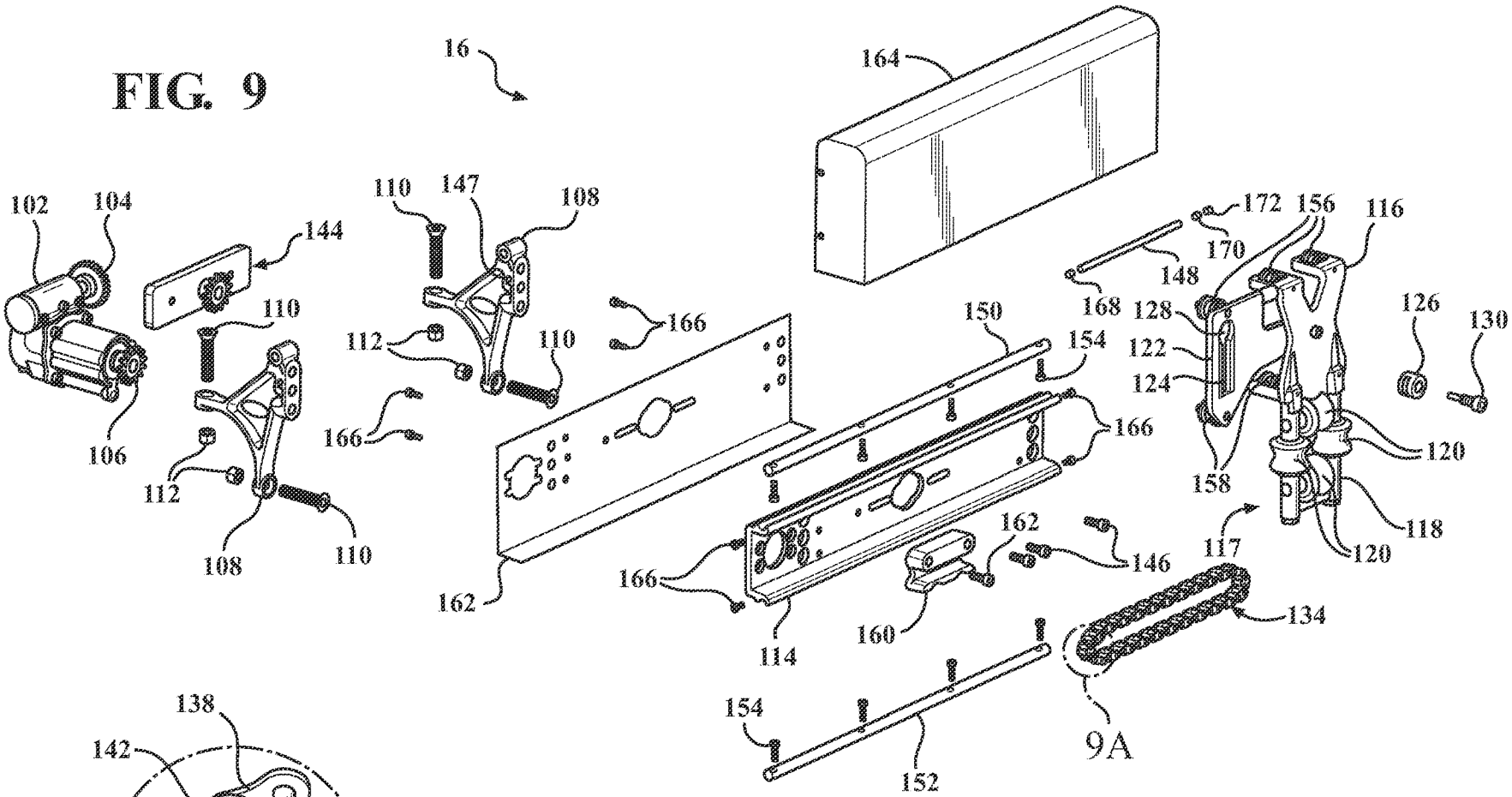
FIG. 9 shows an exploded view of the components of the level wind device.

To coordinate the movement of the spool assembly 14 to the level wind device 16, the gear segments 94 may further interface with a gear box 102 of the level wind device, which is illustrated in greater detail in the exploded view shown in FIG. 9. The gear box 102 receives the motion of the spool assembly 14 at the level wind gear 104. The motion is communicated through a worm gear screw and wheel (not shown in FIG. 9) within the gear box 102, and output to the level wind device 16 via a roller chain sprocket 106.

The level wind device 16 is supported on the frame assembly 12 by mounting brackets 108. The mounting brackets 108 may be secured to the frame assembly 12 with fasteners 110, 112. Alternatively, the mounting brackets 108 may be secured to the frame assembly by welding or other suitable means. In one alternative, the mounting brackets 108 may be formed integrally with the frame 30 of the frame assembly 12. The mounting brackets 108 may be made of a metal or other rigid material, for example, through casting, machining, or other conventional methods.

The mounting brackets 108 support a main mounting plate 114 of the level wind device 16. Supported on the main mounting plate 114 are the functional components of the level wind device 16 to guide the hose as it is wound around the spool assembly 14. A carriage assembly 116 moves back and forth across the length of the spool assembly 14 to guide the hose during winding and unwinding. The carriage assembly 116 includes an alignment guide 117 in the form of a roller frame 118 that includes a plurality of rollers 120 that surround the hose and freely rotate as the hose moves through roller frame 118. Although illustrated with four rollers 120, three, five, or more rollers 120 may be employed, sized and spaced to surround the hose.

The carriage assembly 116 also includes a carriage guide 122. The carriage guide 122 is connected to or formed integrally with the carriage assembly 116. The carriage guide 122 is formed with a guide slot 124. The guide slot 124 receives a slider bushing 126 that can slide within the guide slot 124. The guide slot 124 may be formed as an elongated keyhole slot that includes an enlarged opening 128 disposed at least at one end of the slot. The enlarged opening 128 may allow the slider bushing 126 to be installed onto the guide slot 124, where the slider bushing 126 is captured to the guide slot 124 once it is moved out of the enlarged opening 128.

Figure 9A:
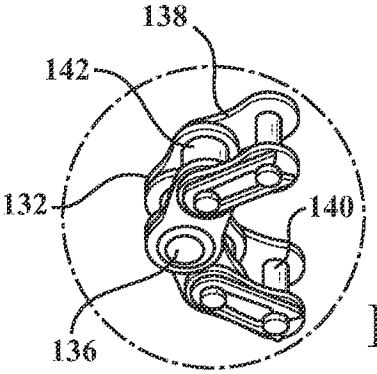
FIG. 9A shows a detailed view of a portion of a roller chain shown in FIG. 9.

The slider bushing 126 supports a pin 130 that extends therethrough. The pin 130 extends beyond the slider busing 126 and is received in a rivet link 132 of the roller chain assembly 134. The rivet link 132 is shown in greater detail in FIG. 9A. The rivet link 132 includes rivet 136 that has a hollow interior to receive pin 130. Other than the rivet 136, the roller chain assembly 134 includes a series of links 138 spanning between pins 140. Supported on the pins 140 are rollers 142 to minimize the resistance and friction at the roller chain sprocket 106.

With the pin 130 received in the rivet link 132, the carriage guide 122 drives the carriage assembly 116 to translate back and forth along the spool assembly 14 due to the chain assembly 134 being rotated by the roller chain sprocket 106. An idler sprocket assembly 144 supports an end of the chain assembly 134 opposite the gear box 102. The idler sprocket assembly is adjustably mounted to the main mounting plate 114 with fasteners 146. The idler sprocket assembly 144 provides variable tension to the chain assembly 134 by operation of a tensioning rod 148. The tensioning rod 148 may be accessible while in use in the hose reel assembly 10 and without needing any further disassembly before adjusting the tension. The tensioning rod 148 may be secured at a first end to the idler sprocket assembly 144 with, for example, nut 168. The second end, opposite the first end, of the tensioning rod 148 extends through an opening 147 in the mounting bracket 108 and can be adjusted and secured against the mounting bracket 108 with inner nut 170 and locked into place with the outer nut 172.

The motion of the carriage assembly 116 is guided by top and bottom bearing rods 150, 152. The top and bottom bearing rods 150, 152 may be secured to the main mounting plate 114 with fasteners 154. The top and bottom bearing rods 150, 152 provide a smooth surface across which the carriage assembly 116 translates. The carriage assembly 116 includes one or more top rollers 156 and one or more bottom rollers 158 to interface with and roll along the top and bottom bearing rods 150, 152. The carriage assembly 116 is illustrated to include two top rollers 156 and two bottom rollers 158 and the carriage guide 122 is illustrated to include one top roller 156 and one bottom roller 158, but this is not intended to be limiting and other configurations are possible without departing from the scope of the present disclosure.

Optionally, the level wind device 16 may include a chain guide 160 supported on the main mounting plate 114 and held in place with fasteners 162. The chain guide 160 can assist in ensuring the proper positioning of the chain assembly 134 in the level wind device 16. The chain guide 160 may be made of a low friction material or may have a low friction surface to guide the chain assembly 134 without substantially increasing resistance or friction.

The level wind device 16 may be enclosed to protect the chain assembly 134 and the roller chain sprocket 106 and idler sprocket assembly 144 with a back cover 162 and a front cover 164. The front and back covers 162, 164 may be held in place to the main mounting plate 114 using fasteners 166. The back cover 162 may extend below the main mounting plate 114 so that only the alignment guide 117, in the form of the roller frame 118, extends from the enclosed space of the level wind device 16.

Figure 10:
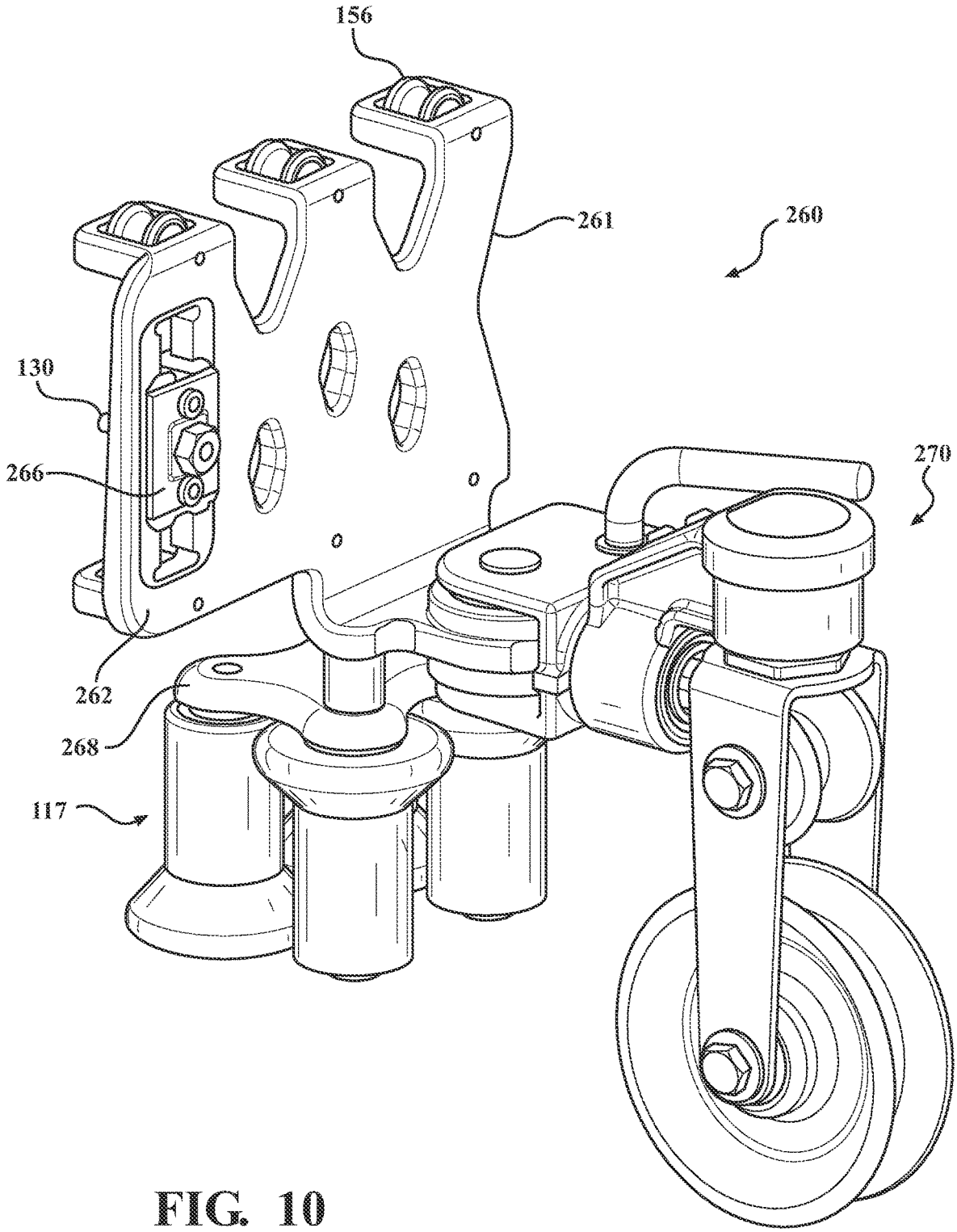
FIG. 10 shows a level wind device including a roller matrix and a gimbal guide in a deployed position.

FIG. 10 illustrates an alternative carriage assembly 260 for use with the level wind device 16. The carriage assembly 260 is similar to the carriage assembly 116 in having one or more top rollers 156 and one or more bottom rollers 158 to interface with and roll along the top and bottom bearing rods 150, 152. The carriage assembly 260 includes a carriage 261 that may be formed integrally with a carriage guide portion 262 or may be formed separately as illustrated with the carriage assembly 116 and carriage guide 122. The carriage guide portion 262 includes a guide slot 264. A slider bushing 266 is disposed within the guide slot 264. The guide slot 264 is formed as an I-slot with enlarged ends to aid manufacturability. The slider bushing 266 may be formed as two pieces held together via threaded fasteners to sandwich the edges of the guide slot 264 and to support the pin 130 for engagement with the roller chain assembly 134. The pin 130 may be threaded into one half of the slider bushing 266 where the other half has a smooth walled through-hole for accommodating the pin 130. In other alternatives, the slide bushing 266 may be formed as a single body as with slider bushing 126, and the guide slot 264 may be formed as an elongated keyhole slot similar to the guide slot 124.

The carriage assembly 116 supports the alignment guide 117 in the form of a roller matrix 268, and a gimbal guide 270. The alignment guide 117 supports the hose in alignment with the spool assembly during winding or unwinding operations. The gimbal guide 270 guides the hose portion extending from the alignment guide 117 when the hose extends in an oblique direction from the hose reel 10. That is, when the hose extends from the spool assembly at an angle other than straight outward, the gimbal guide 270 supports the hose and rotates to accommodate and align with the hose in the desired direction. In one example, the hose reel assembly 10 may be provided on a rear of a vehicle such as a tanker or bobtail truck and arranged so that the straight outward unwind direction, e.g. a 0° angle, extends rearwardly of the vehicle. It is desirable to provide a hose guide to allow the hose to be unwound from the hose reel assembly 10 in either direction adjacent the hose reel and perpendicular to the straight outward unwind direction, e.g., at an angle of ±90° from straight outward.

Figure 11:
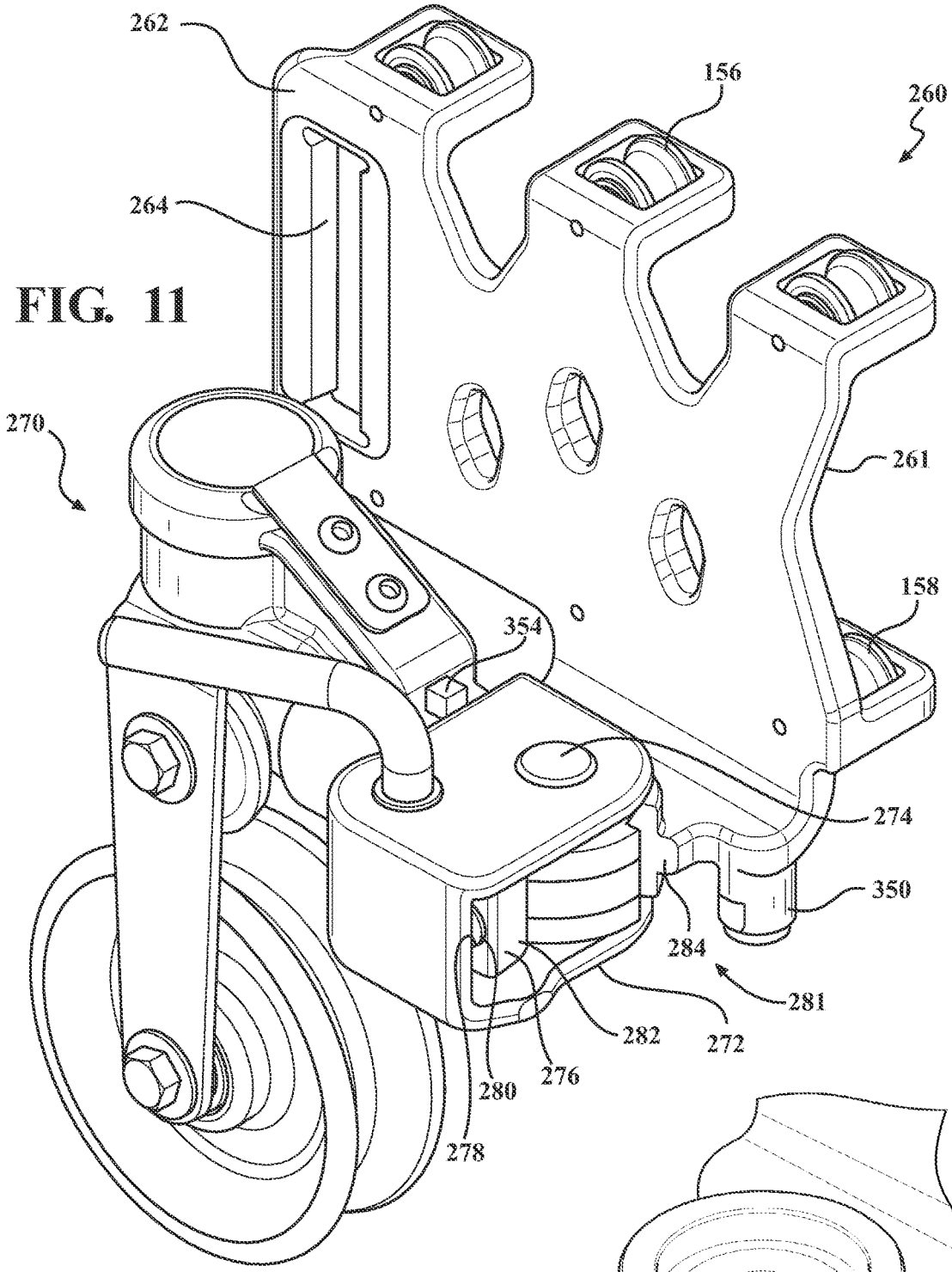
FIG. 11 shows a level wind device including a gimbal guide in a storage position.

The gimbal guide 270 may be arranged to provide a storage position, as illustrated in FIG. 11, to support the hose when the hose is stored, for example, during transportation on the vehicle. FIG. 11 illustrates the carriage 261 and the gimbal guide 270 in the storage position. Although not illustrated, it should be understood that the carriage assembly 260 in use is further assembled and includes other components not illustrated in FIG. 11, such as the alignment guide 117 and the other components and features illustrated in the other figures. In some alternatives, the level wind device 16 may include the gimbal guide 270 while excluding the alignment guide 117. The hose may include a hose end valve (not shown) that is secured in a holster or other retention mechanism during transportation on the vehicle. The holster may be provided adjacent to the hose reel assembly 10, thereby requiring the hose to traverse a tight curvature when the hose is wound onto the spool and the hose end valve is retained to the holster. The gimbal guide 270 may be arranged to support the hose and limit the minimum bend curvature to prevent damage or kinking of the hose and ensure the hose does not come into contact with sharp edges or rough surfaces that may be present on or near the hose reel assembly 10, the vehicle or the holster.

The gimbal guide 270 may be arranged to move from the storage position to a deployed position (as illustrated in FIG. 10). In one example, the gimbal guide is maintained in the storage position by the retention of the hose end valve in the holster. Upon removal of the hose end valve from the holster, the gimbal guide 270 may freely rotate from the storage position to the deployed position. In other words, the carriage assembly 260 may not include any mechanism to lock the gimbal guide 270 in the storage position and therefore not require any disengagement or unlocking to move into the deployed position. Conversely, the gimbal guide 270 may be arranged to lock into place when in the deployed position and require some actuation in order to allow the gimbal guide 270 to transition from the deployed position to the storage position. In other alternatives, the carriage assembly 260 includes a second locking mechanism to lock or retain the gimbal guide 270 in the storage position.

Figure 11A:
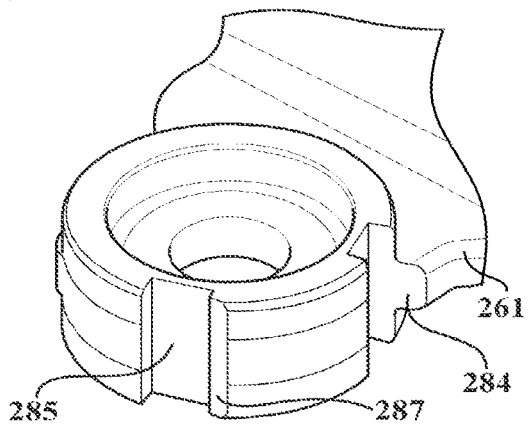
FIG. 11A shows a detailed view of an example gimbal guide support of the carriage shown in FIG. 11.
Figure 12:
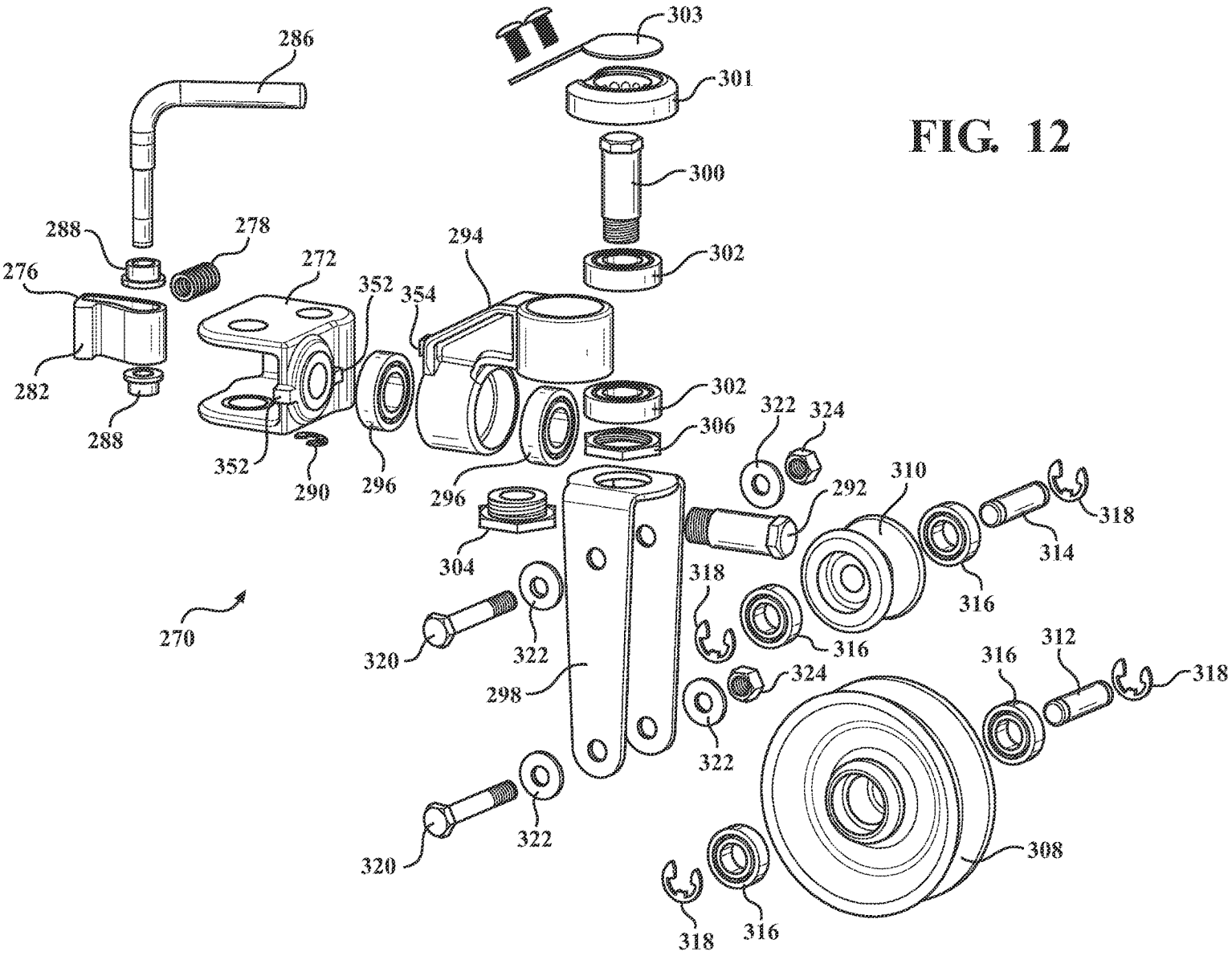
FIG. 12 shows an exploded view of the components of the gimbal guide of FIGS. 10 and 11.

The gimbal guide 270 is illustrated in an exploded component view in FIG. 12. The gimbal guide 270 is supported on the carriage 261 at a gimbal guide support 281 via a clevis 272 and clevis pin 274. One or more bearings may be provided between the carriage 261 and the clevis 272 for rotation between the storage position and the deployed position. The gimbal guide 270 may include a latch 276 supported on the clevis 272. The latch 276 may be biased against the clevis 272 via spring 278 which can be disposed in a recess 280 on the latch 276. The latch 276 may include a pawl 282 arranged to be received in a notch 284 of the carriage 261 to releasably retain the clevis relative to the carriage 261. When the gimbal guide 270 is in the storage position, the pawl 282 slides along a surface of the carriage 261 with the spring 280 compressed and when the gimbal guide 270 is moved to the deployed position the pawl moves into notch 284 under the force of the spring 280. In another alternative, when the gimbal guide 270 is in the storage position, the pawl 282 may be received in a storage notch 285, which is illustrated in FIG. 11A. In one or more alternatives, the notch 284 or the storage notch 285, or both, may be provided with a chamfered edge 287. The chamfered edge 287 may aid in urging the gimbal guide 270 into the storage position, where provided on storage notch 285, or into the deployed position, where provided on the notch 284.

A latch handle 286 may extend through the clevis 272 and the latch 276 in order to actuate the latch 276 and remove the pawl 282 from the notch 284, or storage notch 285, where present. The handle 286 may have a section having a square cross-section with a complimentary square pocket formed in the latch 276. Bushings 288 may be provided between the clevis 272 and the handle 286 to provide a low friction interface for rotation of the handle 286 relative to the clevis 272. The handle 286 may be retained through the clevis 272 by an E-ring 290, snap ring or other suitable retention mechanism.

A first pivot pin 292 extends from the clevis 272 to support a yoke 294 for rotation about a first axis. The first axis in the illustrated figure is a horizontal axis, which in the deployed position extends outwardly from the carriage 261. Bearings 296 may be provided between the pivot pin 292 and the yoke 294 for easy rotation about the pivot pin 292. The yoke 294 supports a fork 298 for rotation relative to the yoke about a second axis, substantially perpendicular to the first axis. A second pivot pin 300 extends through the yoke 294 and secures to the fork 298 for pivotal rotation. Bearings 302 may be provided between the yoke 294 and the pivot pin 300 for easy rotation of the fork 298 relative to the yoke 294. A threaded bushing 304 may be provided in combination with a lock nut 306 to secure the fork 298 to the pivot pin 300. Optionally, a cap 301 and cover 303 may be provided on the yoke to enclose the bearing 302 and pivot pin 300 to protect the components against exposure to external environments which may allow dirt, moisture or other contaminants that could degrade the operation of the gimbal guide 270. The cap 301 and cover 303 may be assembled to the yoke via threaded fasteners, threaded interfaces, press-fit, or any other suitable mechanism.

The fork 298 is arranged to align the hose with a direction of a pulling or driving force as it is wound or unwound at an oblique angle from the hose reel assembly 10. The fork 298 facilitates this alignment by rotation of the yoke 294 relative to the clevis 272 and by rotation of the fork 298 relative to the yoke 294, where the axes of rotation are substantially perpendicular to one another. This complex rotation of the gimbal guide 270 allows the hose to remain in contact primarily with the large diameter roller 308. The large diameter roller 308 is sized according to the hose diameter, wall thickness, material composition or other parameters so that the hose maintains a substantially constant cross sectional area through the range of engagement between the hose and the large diameter roller 308. Substantially constant refers to real world conditions where hose material may not achieve geometrical or mathematical perfection. For example, substantially constant cross sectional area means that the cross sectional area deviates by less than 15%. Having a roller of a small diameter may cause a hose to flatten or kink as it extends around the roller. Maintaining a minimum radius of curvature according to the size of the hose, the wall thickness, material composition or other characteristics of the hose ensures that local deformation of the hose is minimized while also reducing any sliding friction of the hose on a roller that cannot align to the direction of force during winding or unwinding of the hose.

A small diameter roller 310 may also be provided on the fork 298. The small diameter roller 310 may prevent the hose from contacting the edges or surfaces of the fork 298. In a typical implementation where the hose is being wound or unwound, the hose makes minimal or incidental contact with the small diameter roller 310 while remaining in contact with the large diameter roller 308.

The large and small diameter rollers 308, 310 are supported on the fork 298 for rotation relative to the fork 298. In one alternative, the large and small diameter rollers 308 and 310 are respectively supported on axles 312, 314 by bearings 316. The assembled rollers 312, 314 and bearings 316 are retained to the axles 312, 314 by E-rings 318, snap rings, or other suitable mechanism. The assemblies supporting the rollers 312, 314 may be retained to the fork 298 by threaded fasteners, such as bolts 320, washers 322, and nuts 324. In other alternatives, any other suitable arrangement may be used to secure and support the rollers 312, 314 on the fork 298.

The carriage assembly 260 includes gimbal guide 270 to align with a force applied to the hose and further includes the roller matrix 268 to align the hose with the spool assembly 14. The roller matrix 268 cooperates with the gimbal guide 270 to allow the hose to wind and unwind from the spool assembly while minimizing any rolling or sliding forces. As an alternative to the roller frame 118, which can cause sliding friction between the rollers 120 and the hose, the roller matrix 268 provides eight independently rotating guide surfaces to guide the hose onto the spool assembly 14. The roller matrix 268 is shown in FIG. 13 in an exploded component view.

Figure 13:
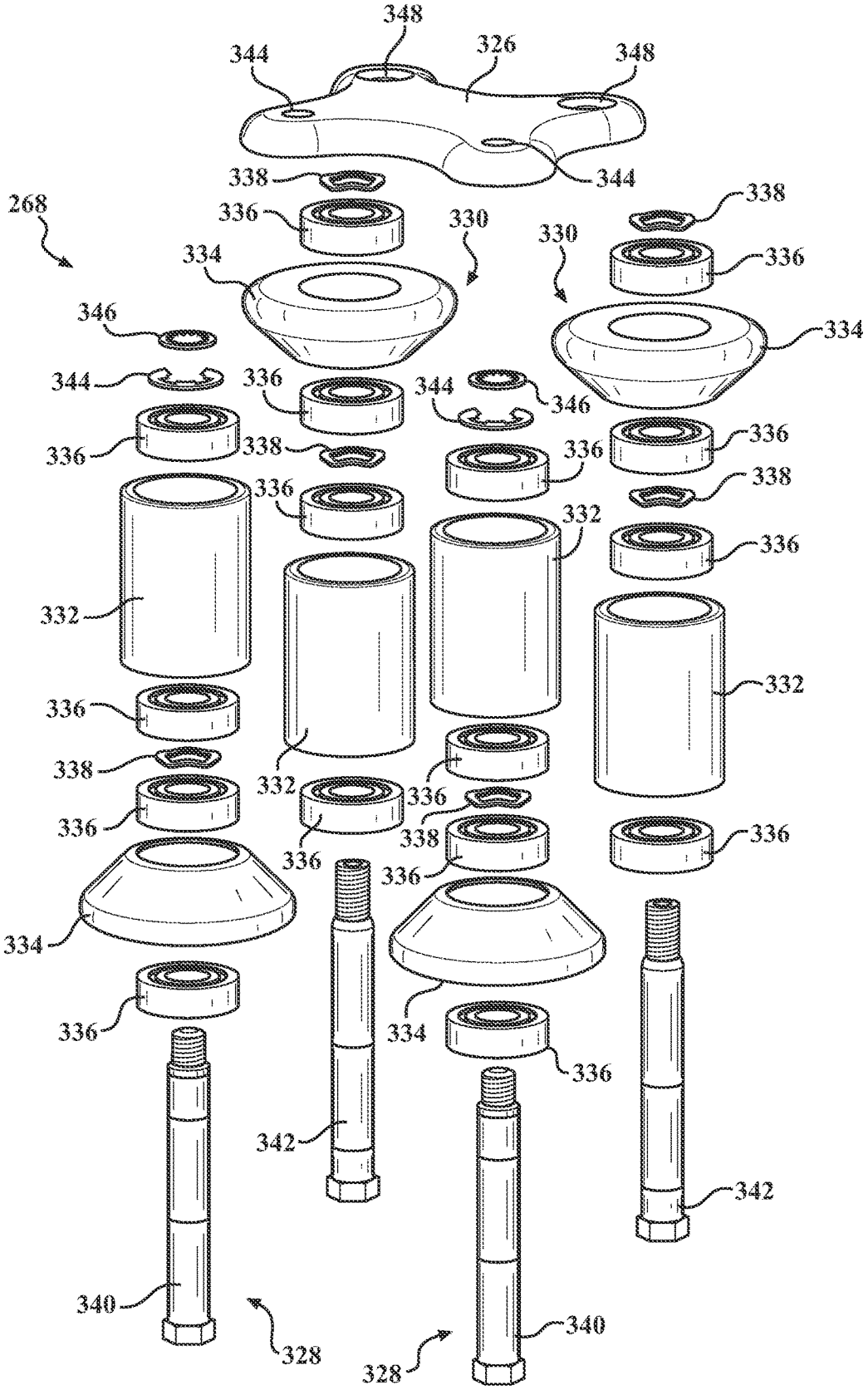
FIG. 13 shows an exploded view of the components of the roller matrix of the level wind device shown in FIG. 10.

In the example illustrated in FIG. 13, the roller matrix 268 includes a plate 326 to support a first pair of proximal roller stacks 328 and a second pair of distal roller stacks 330. The first pair of proximal roller stacks 328 are disposed closer to the spool assembly 14 and the second pair of distal roller stacks 330 are farther away from the spool assembly 14 relative to the first pair of proximal roller stacks 328. Each roller stack of the first and second pairs 328, 330 comprises a first cylindrical roller 332 and a second frustoconical roller 334 supported on bearings 336. The first pair of proximal roller stacks 328 are arranged with the frustoconical rollers 332 disposed beneath the cylindrical rollers 332 to support the hose vertically. The second pair of distal roller stacks 330 are arranged with the frustoconical rollers 332 disposed above the cylindrical rollers 332 to limit any upward movement of the hose as the hose transitions from the roller matrix 268 to the gimbal guide 270. Spacers or washers 338 may be disposed between the cylindrical rollers 332 and the frustoconical rollers 334 to prevent any friction between adjacent rollers and further ensure their independent rotation.

The roller stacks 328, 330 are assembled to the plate 326, for example, via threaded fasteners such as bolts 340, 342. The bolts 340 secure the first pair of proximal roller stacks 328 to the threaded apertures 344 formed in the plate 326. One or both of the first pair of proximal roller stacks 328 may be removed from the plate 326 in order to assemble the hose to the roller matrix 268. With the first pair of proximal roller stacks 328 in place, the hose cannot pass between the frustoconical rollers 334 to be assembled into the roller matrix 268. The bolts 340 may include E-rings 344 to retain the assembled cylindrical rollers 332 and frustoconical rollers 334 in place when removed from the plate 326. Internal tooth lock washers 346 may be provided to ensure that the first pair of proximal roller stacks 328 do not unintentionally loosen from the plate 326.

The plate 326 may include apertures 348 through which bolts 342 pass to secure the roller matrix 268 to the carriage 260 at bosses 350 provided with threaded pockets to receive the bolts 342. The plate 326 and the carriage 260 at bosses 350 may be provided with complementary surface geometry in order to precisely locate the plate 326 on the carriage 260 during an assembly process.

Figure 14:
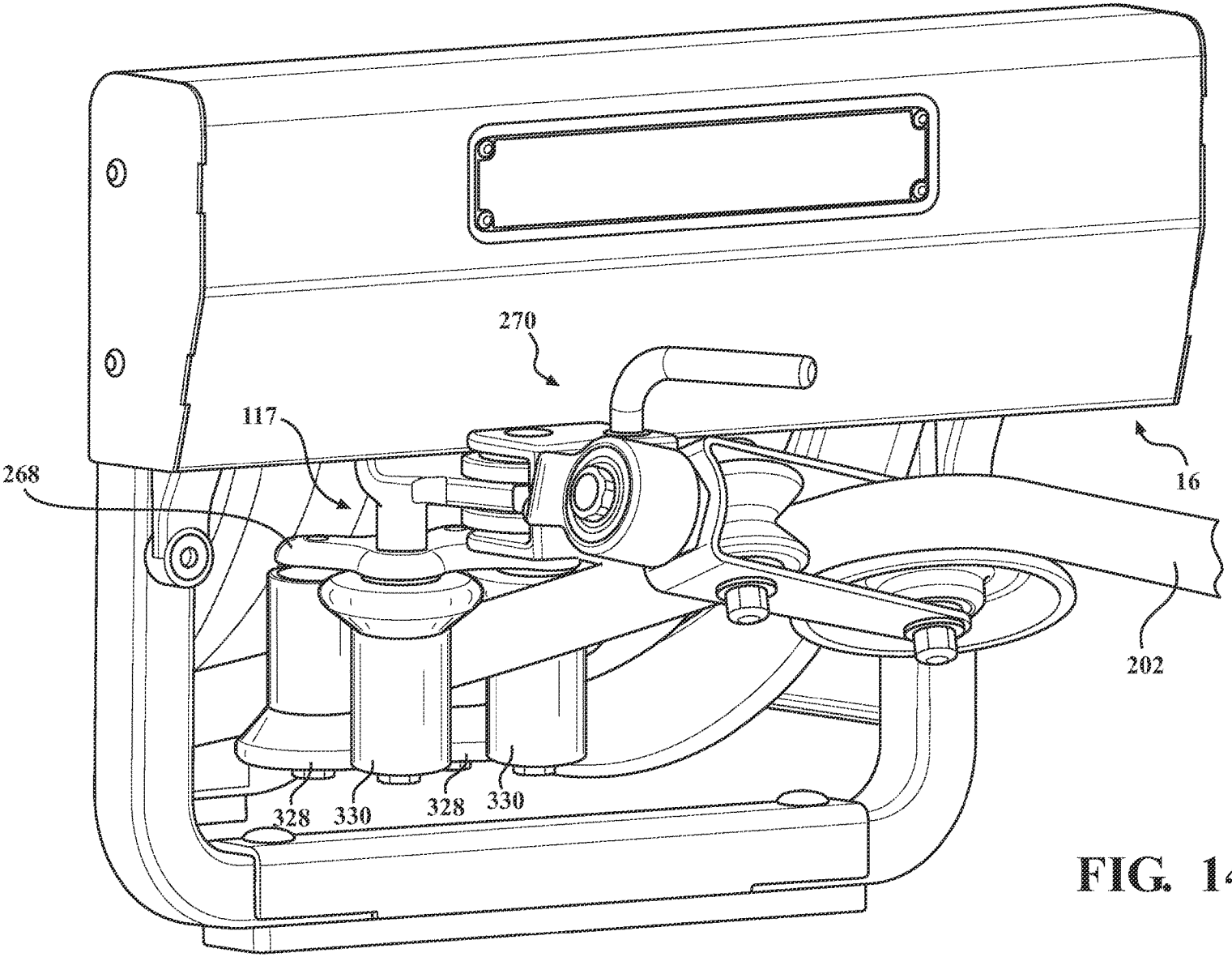
FIG. 14 shows an example implementation of the level wind device guiding a hose in an oblique direction.

Articulation of the gimbal guide 270 is illustrated in FIG. 14, with a hose 202 shown in a partially unwound condition extending from the spool assembly 14 through the alignment guide 117, that is the roller matrix 268, and through the gimbal guide 270. The hose 202 is subject to a pulling force substantially perpendicular to the direction that the hose 202 winds onto the spool assembly 14. The first pair of proximal roller stacks 328 support the hose 202 from the sides and bottom of the hose 202. The second pair of distal roller stacks 330 constrain the hose 202 on the sides and top of the hose 202. The spacing between the respective ones of the first pair of proximal roller stacks and the respective ones of the second pair of distal roller stacks is determined by the size of the hose so that in a relaxed state the hose maintains contact with each of the roller stacks 328, 330 simultaneously and without compressing the hose 202. The spacing from the first pair of proximal roller stacks 328 to the second pair of distal roller stacks 330 may be closer than between respective ones of the first or second pairs of roller stacks. For example, the space from first pair of proximal roller stacks 328 to the second pair of distal roller stacks 330 may be just slightly larger than the difference in outer circumference of the frustoconical roller 334 and the cylindrical roller 332. This arrangement may minimize the overall size of the roller matrix 268 while avoiding any contact between adjacent rollers. For example, the minimum spacing between the cylindrical roller 332 of the first pair proximal roller stacks and the frustoconical roller 334 of the second pair of distal roller stacks 330 may be at least 1 millimeter, or between 1 and 5 millimeters.

The hose 202 exits the roller matrix 268 and extends around the large diameter roller 308 of the gimbal guide 270. As illustrated in FIG. 14, the yoke 284 of the gimbal guide 270 is rotated about the pivot pin 292 and the fork 298 is rotated about the pivot pin 300. This allows the hose 202 to maintain contact with the large diameter roller 308 over approximately 90° of the large diameter roller's 308 circumference. The yoke 294 and the fork 298 may be limited in their range of rotation. For example, clevis 272 may be arranged to limit the rotation of the yoke 294. The clevis 272 includes bosses 352 arranged about 180° apart. Yoke 294 includes a complementary boss 354 that contacts one or the other of the bosses 352 as the yoke 294 rotates to the end of its range of movement. The fork 298 may contact the yoke 294 to limit the rotational range of the fork 298 relative to the yoke 294. The range of rotation of the fork 298 may be more limited than the range of rotation of the yoke 294. In one example, the yoke 294 may rotate about 180° relative to clevis 272, about 90° in each direction, and the fork 298 may rotate less than 90° relative to the yoke 294, about 45° in each direction from a neutral position. In other alternatives, the yoke 294 may rotate about 160° relative to clevis 272, about 80° in each direction, and the fork 298 may rotate less than 45° relative to the yoke 294. The relative range of rotation for the yoke 294 or the fork 298 may depend on the dimensional scale or the intended application of the hose reel assembly 10. Alternatively, or in addition, the relative range of rotation for the yoke 294 or the fork 298 may depend on the hose size, wall thickness, or material composition to achieve desirable performance characteristics associated with reducing friction and maintain the cross-sectional consistency of the hose. In other alternatives, the relative rotation of the yoke and the fork may be unconstrained, or else may be biased by one or more springs, such as torsional springs that urge the yoke or the fork into a neutral position.

The carriage assembly 260 is illustrated in an exemplary manner, and the illustrated construction is not intended to be limiting and alternative constructions are possible without departing from the scope of this disclosure. In one example, the components of the carriage assembly 260 may be a combination of common commercially available components of bolts, bearings, and the like, with specialized components such as the carriage 261, clevis 272, latch 276, yoke 294, fork 298, plate 326, cylindrical rollers 334 and frustoconical rollers 332. These components may be formed of metal, such as steel, aluminum, or other suitable materials for the intended application. These components may be formed using conventional manufacturing processing, including, for example, casting, forging, machining, and the like. In other alternatives, certain components may be formed of a plastic or polymeric material using conventional manufacturing processes. It should be further understood that the components illustrated as an integrated body may be formed in multiple portions and assembled together. In one example, the large diameter roller 308 may optionally be formed from two large diameter frustoconical rollers arranged for independent rotation relative to one another on the axle 312. Likewise, components illustrated as multiple separate pieces may be formed as a singular integrated body. In one example, the carriage 261 may be formed integrally with the plate 326 to support the roller matrix 268 directly on the carriage 261.

Figure 15:
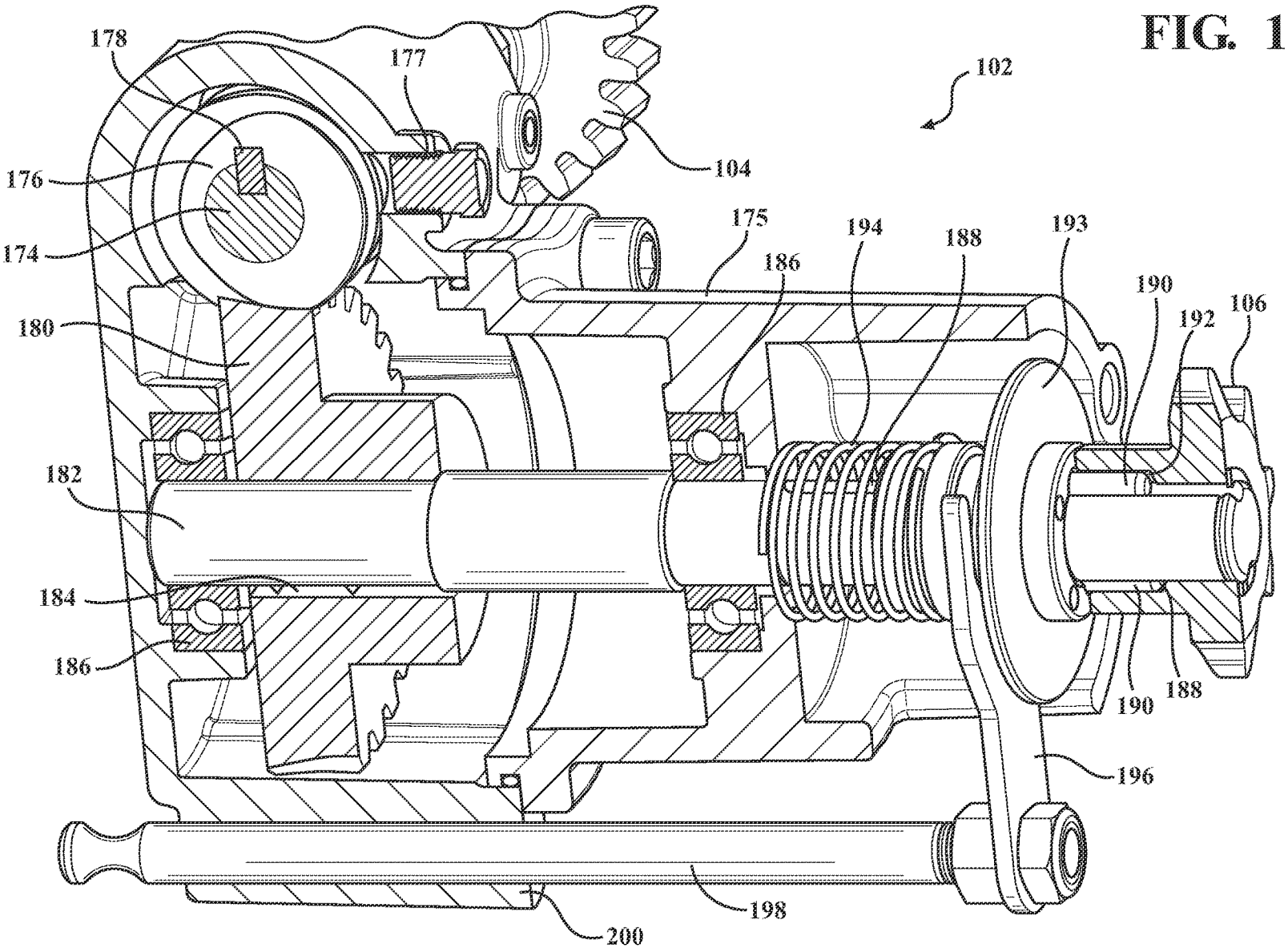
FIG. 15 shows a partial cross section of a gear box having a disengagement clutch in an engaged configuration.
Figure 16:
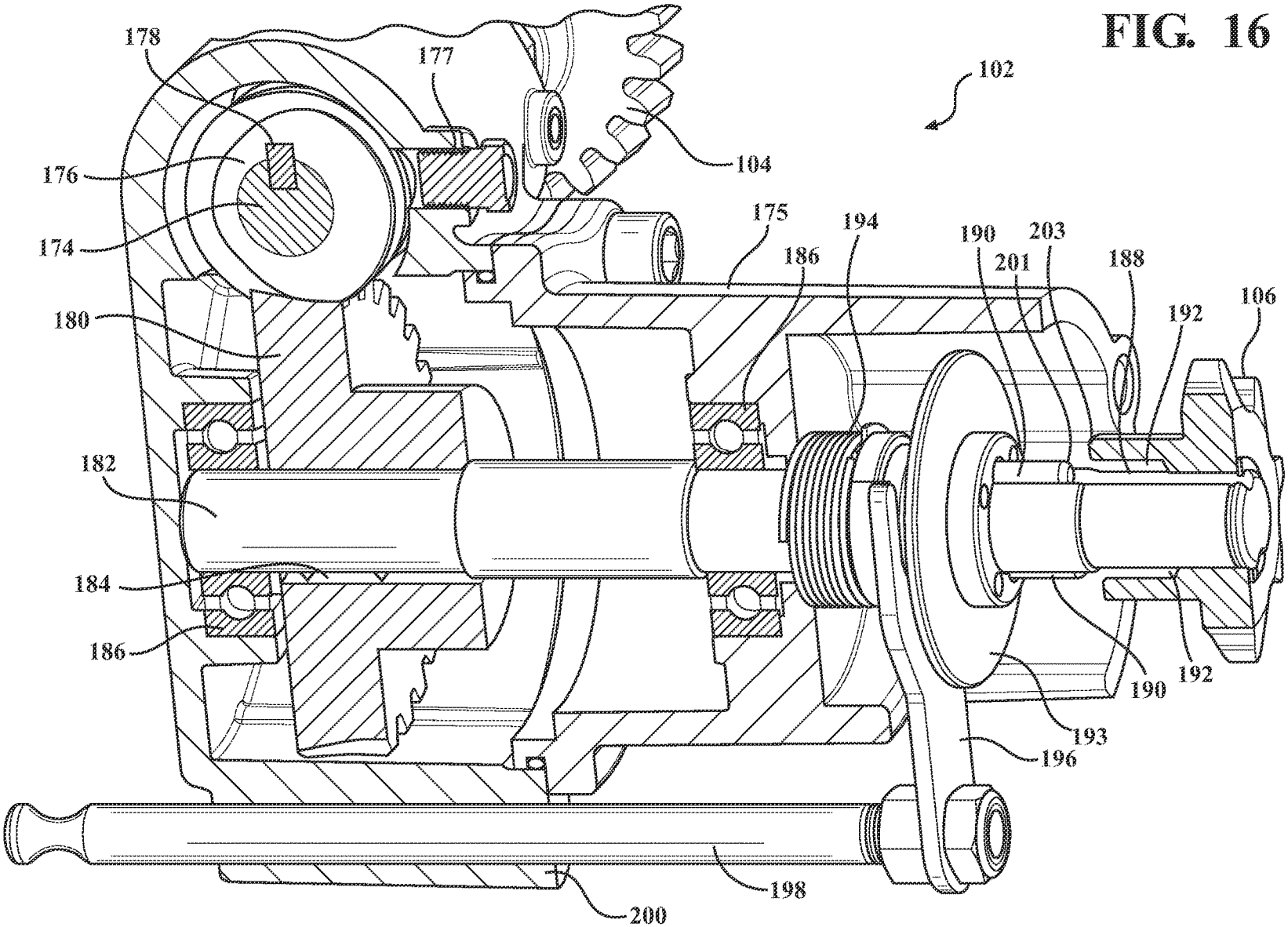
FIG. 16 shows a partial cross section of a gear box having a disengagement clutch in a disengaged configuration.

During operation of the hose reel assembly 10, and particularly during installation of a hose onto the hose reel assembly 10, it may be desirable to provide the level wind device 16 with a gear box 102 having a disengagement clutch to decouple the movement of the carriage assembly 116 from the movement of the spool assembly 14. FIGS. 15 and 16 show a partial cross-sectional view through the gear box 102 in an engaged configuration and a disengaged configuration, respectively. In the engaged configuration, the gear box 102 transmits the motion from the spool assembly 14 to the carriage assembly 116, and in the disengaged configuration, the spool assembly 14 and the carriage assembly move independently.

In the engaged configuration, the gear segments 94 of the spool assembly 14 rotate the level wind gear 104 as the spool assembly 14 is rotated by the motor assembly 18. The gear box 102 includes a housing 175 that may comprise one or more housing components secured together, for example, with fasteners. The housing 175 shields the mechanisms of the gear box 102 from environmental contaminants, and may further serve to reduce corrosion and increase reliability. One or more lubrication ports 177 may be provided in the housing to allow the introduction of lubricants onto the mechanism, or to allow for inspection of the components without requiring disassembly of the housing 175. A plug or grease fitting may be installed in the lubrication port 177. The gear box 102 includes the level wind gear 104 that is secured to a shaft 174 for rotational movement therewith, for example with a woodruff key, set screw, or the like. Rotation of the shaft 174 turns the worm gear screw 176 which is likewise mounted to the shaft 174 for rotation therewith, for example, with woodruff key 178. The worm gear screw 176 is engaged with worm gear wheel 180. The worm gear wheel 180 can turn a clutch shaft 182 through the woodruff key 184 disposed therebetween. One or more bearings 186 may be provided within the gear box 102 to support the shaft 174 or clutch shaft 182 and provide for low resistance rotation.

The clutch shaft 182 extends from an interior of the gear box housing 175 and terminates at the roller chain sprocket 106. The clutch shaft 182 may include one or more recesses 188 to receive a portion of a clutch pin 190. The clutch pin 190 does not fully depress into the clutch shaft 182 but is instead received in a bore 192 of the roller chain sprocket 106 and arranged for slidable translation along the clutch shaft 182. Although illustrated with two oppositely disposed recesses 188, clutch pins 190, and bores 192, this is not intended to be limiting and other numbers and configurations are consistent with the scope of the present disclosure. For example, one, three, or more recesses, pins, and bores may be used.

The clutch pins 190 may be secured to the clutch shaft 182 by a clutch bushing 193. The clutch bushing 193 captures the clutch pins 190 to clutch shaft 182 and is slidable along the length of the clutch shaft 182. A spring 194 may be provided between the clutch bushing 193 and the gear box housing 175 to bias, or urge, the clutch bushing 193 away from the housing 175. When the spring 194 is extended, the clutch pins 190 are received in the roller chain sprocket 106 and the clutch is engaged.

The spring 194 can be compressed, and the clutch pins 190 withdrawn from the roller chain sprocket 106 by sliding the clutch bushing 193 along the clutch shaft 182 away from the roller chain sprocket 106, as illustrated in FIG. 16. A clutch yoke 196 may engage and extend from the clutch bushing 193. At an end opposite the clutch bushing 193, the clutch yoke 196 may support a clutch rod 198. The clutch rod 198 may extend away from the clutch yoke 196 and through a sleeve 200 formed in the gear box housing 175. The sleeve 200 retains the clutch rod 198 for translational motion parallel to the clutch shaft 182. The clutch rod 198 located in this position may reduce a likelihood of accidental operation and requires deliberate effort to operate. Operation of the clutch rod 198 can be performed by one hand of an operator while the other hand moves the carriage assembly 116 or manually rotates the spool assembly 14.

The clutch is disengaged by pulling on the clutch rod 198 and remains disengaged only as long as the clutch rod remains pulled out by an operator against the force of spring 194. When the clutch rod 198 is released, the clutch bushing automatically moves under the force of spring 194 back toward the roller chain sprocket 106 and the clutch pins 190 re-enter the bores 192. The pins 190 and the bores 192 have chamfered edges 201, 203, on the opposing faces to encourage reliable engagement. A surplusage of bores 192 may be provided in the roller chain sprocket 106 in a regular pattern in excess of the number of clutch pins 190. As illustrated, there are two bores 192 and two clutch pins 190, which means that there are two positions of engagement 180° apart along the rotation of the sprocket 106. If four bores 192 are provided and equally spaced apart in the sprocket 106, using two clutch pins 190, there are four positions of engagement 90° apart along the rotation of the sprocket. In an alternative, two clutch pins 190 may be employed, with a roller chain sprocket having six bores 192. In another alternative, three clutch pins 190 may be provided, with the clutch shaft 182 having three recesses 188 spaced equally apart along the circumference of the clutch shaft 182, with the roller chain sprocket having twelve bores 192. The choice of dimensional scale, that is, how large the hose reel assembly 10 is sized, the flexural rigidity of the hose, the motor force and speed, may all impact the choice of the number and size of clutch pins 190 provided between the cutch shaft 182 and the roller chain sprocket 106. Using multiple clutch pins reduces the force load applied at each pin individually and may increase reliability when compared with using fewer or only a single clutch pin.

Using the disengagement clutch aids in aligning the spool assembly 14 with the carriage assembly 116, for example, during installation of a hose onto the hose reel assembly 10. To install the hose, the riser 84 of the spool assembly 14 is position at the bottom of the spool assembly, and the carriage guide 116 is positioned at an end position of its travel, depending on the configuration of the spool assembly 14. The riser 84 extends from the inlet body 78 being joined to the inlet body 78 with a flange joint. This requires that the riser 84 be distanced from the reel end 72 to accommodate the required space for the flange connection to the inlet body 78.

Figure 18:
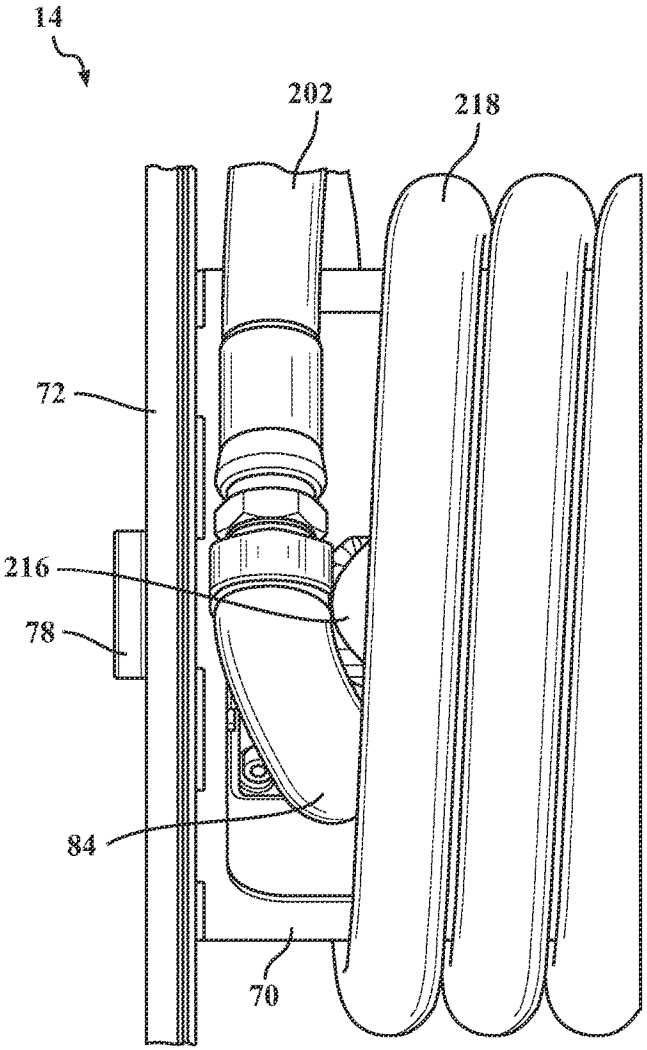
FIG. 18 shows a partial view of the spool assembly in a second configuration.
Figure 17:
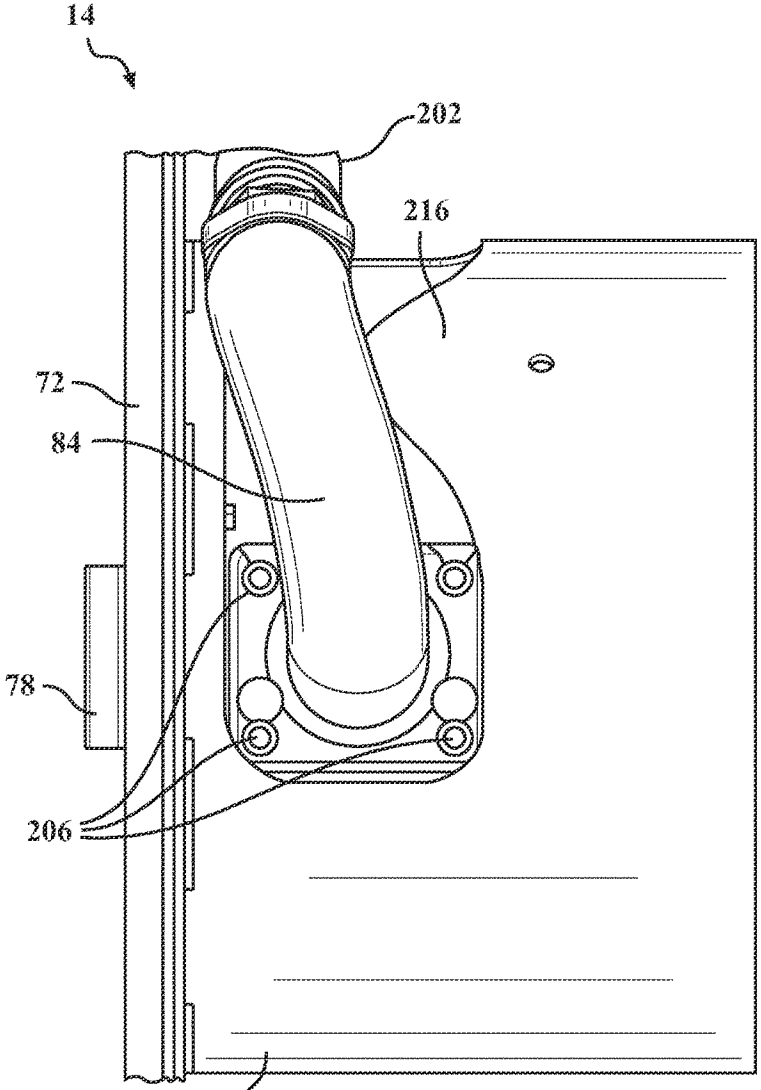
FIG. 17 shows a partial view of the spool assembly in a first configuration.

To improve the space efficiency for winding the hose, and to counteract distancing the riser 84 from the reel end 72, the riser 84 is formed with a curvature along its length to offset the hose connection to be closer to the reel end 72 than the flange connection between the riser and the inlet body within the drum interior. The offset riser 84 is illustrated in FIGS. 17 and 18, which is a partial view of the spool assembly 14 adjacent the reel end 72. In FIG. 17, a hose 202 is connected to the riser, but unwound from the spool assembly 14. In FIG. 18, the hose 202 is wound onto the spool assembly 14. The curved length of the offset riser 84 places the hose connection closer to the reel end 72 than the connection between the riser 84 and the inlet body 78 such connection being partially concealed beneath the hose in the view illustrated in FIG. 18. This prevents subsequent wraps of the hose 202 from being pinched and binding between the riser 84 and the reel end 72. The hose 202 also wraps more evenly on the spool assembly 14 without interference or disruption from the riser 84. Utilizing the spool space more efficiently in this manner ensures that more hose 202 can be wound onto the spool assembly 14 for a given size or else the hose reel assembly 10 can be made smaller for a given length of hose 202 when compared with a riser lacking the offset curvature.

Figure 19:
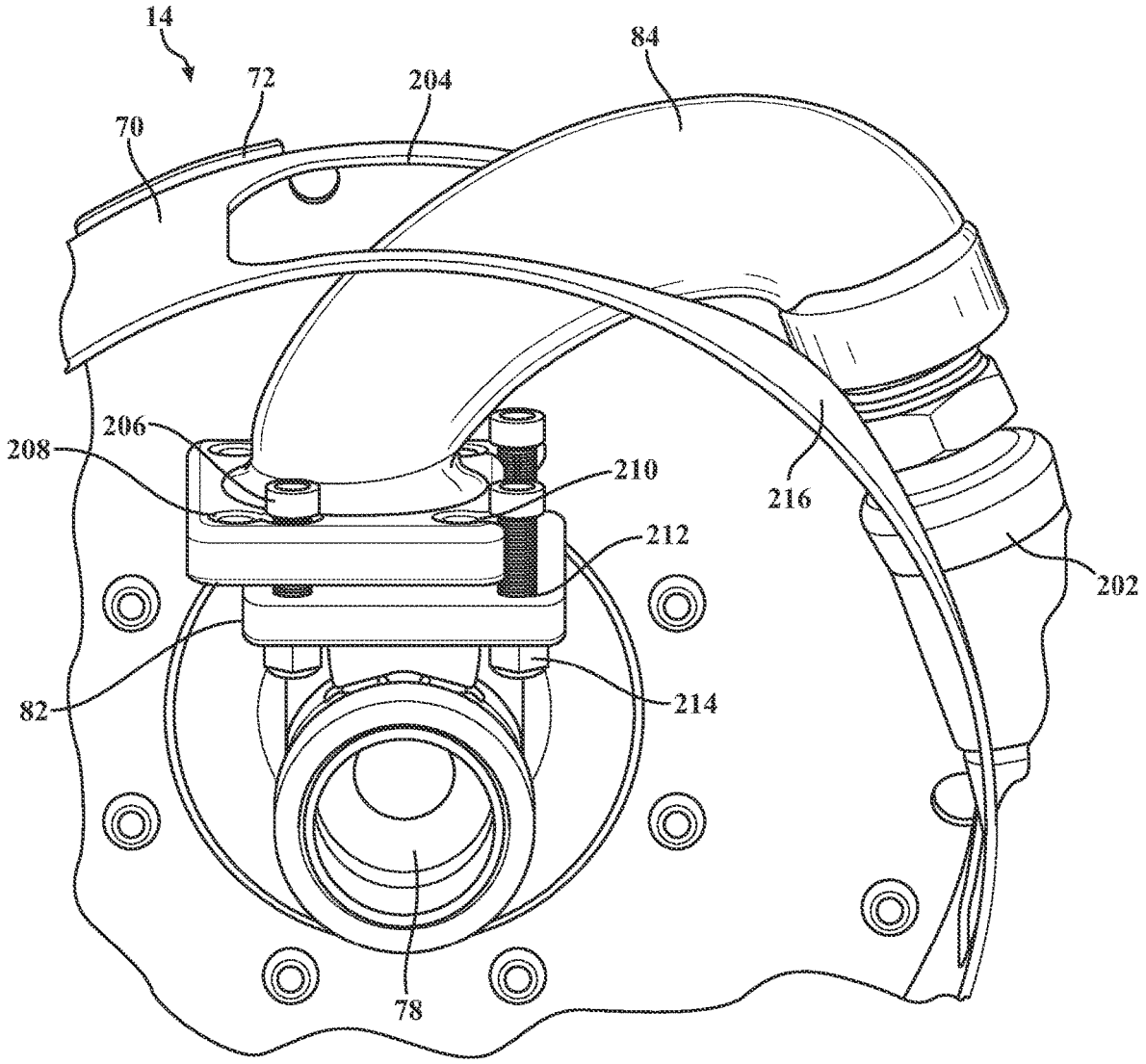
FIG. 19 shows a partial cutaway view of a portion of the spool assembly from a first perspective.

As described above, the inlet body 78 extends from the drum 70 through the reel end 72 to connect to a fluid source via, for example, swivel joint 20 (as shown in FIG. 1). The drum 70 provides a cutout 204 for the riser 84 to connect to the inlet body 78 within the drum 70 and to the hose 202 outside the drum 70 as illustrated in FIG. 19. The cutout 204 is large enough for the flange of the riser 84 to pass through for installation to the inlet body 78. The riser 84 may be secured to the inlet body 78 using fasteners 206. Although illustrated at each corner, the flange connection between the riser 84 and the inlet body 78 may have fewer fasteners, or else may take different form. The flange of riser 84 may be provided with keyhole slots 208, open-edge holes 208, or both, to slip onto fasteners 206 that are captured to the flange 82 of inlet body 78.

As is illustrated, in one example, in FIG. 19, a partial cutaway view of the spool assembly 14 is shown. The flange 82 includes threaded holes 212 to receive the fasteners 206. On a backside of the flange 82, locking nuts 214, for example a nyloc nut or elastic stop nut, is provided on the fasteners 206. The locking nut 214 allows the fasteners 206 to be retracted and loosened from the riser 84. The locking nut 214 acts as a stop to limit the travel of the fastener 206 and retain the fastener 206 to the flange 82. With the fasteners 206 in the retracted position, the riser 84 can be installed or uninstalled, as needed, by sliding the riser 84 over the fasteners 206 through the keyhole slots 208 and open-edge holes 210. The riser 84, once positioned against the flange 82 can be secured to the inlet body 78 by advancing the fasteners 206, tightening the heads of the fasteners 206 against the riser 84 and secured in the threaded holes 212 of the flange 82. In the advanced position, the locking nut 214 remains adjacent the end of the fastener 206. This arrangement of retained fasteners 206 provides fewer independent components to be managed during assembly or service operations and prevents loose fasteners from being dropped in the interior of the drum. The keyhole slots 208 and open-edge holes 210 provide clear indication to the operator when proper alignment is achieved.

The hose reel assembly 10 may be arranged to wind the hose 202 in either direction from left-to-right, or right-to-left, and with either clockwise or counterclockwise rotation when viewed from reel end 72, depending on the desired construction. To facilitate these alternate constructions, the drum 70 may be provided with a cutout 204 that extends around a portion of the reel circumference of about 90°, for example, at least 75° and less than 115°. This extended cutout 204 allows greater access to the interior of the drum 70 for manipulating the inlet body 78 during installation of the inlet body 78 to the reel end 72; or for installing the riser 84 to the inlet body 78. This cutout 204 also allows the inlet body 78 to be installed in two different configurations on the same drum 70. By removing the fasteners 88 from the mounding surface 86 of the inlet body 78, as illustrated in FIG. 8, the inlet body can be installed in multiple orientations relative to the drum 70. When installed in a first orientation, as illustrated in the figures, a riser 84 with a left-handed offset can be installed to position the hose connection adjacent the reel end 72. Rotating the inlet body 78 relative to the drum 70 to orient the second flange 82 at the opposite end of the cutout 204, a riser 84 with an opposite, right-handed offset can be installed to position the hose connection adjacent the reel end 72.

Figure 20:
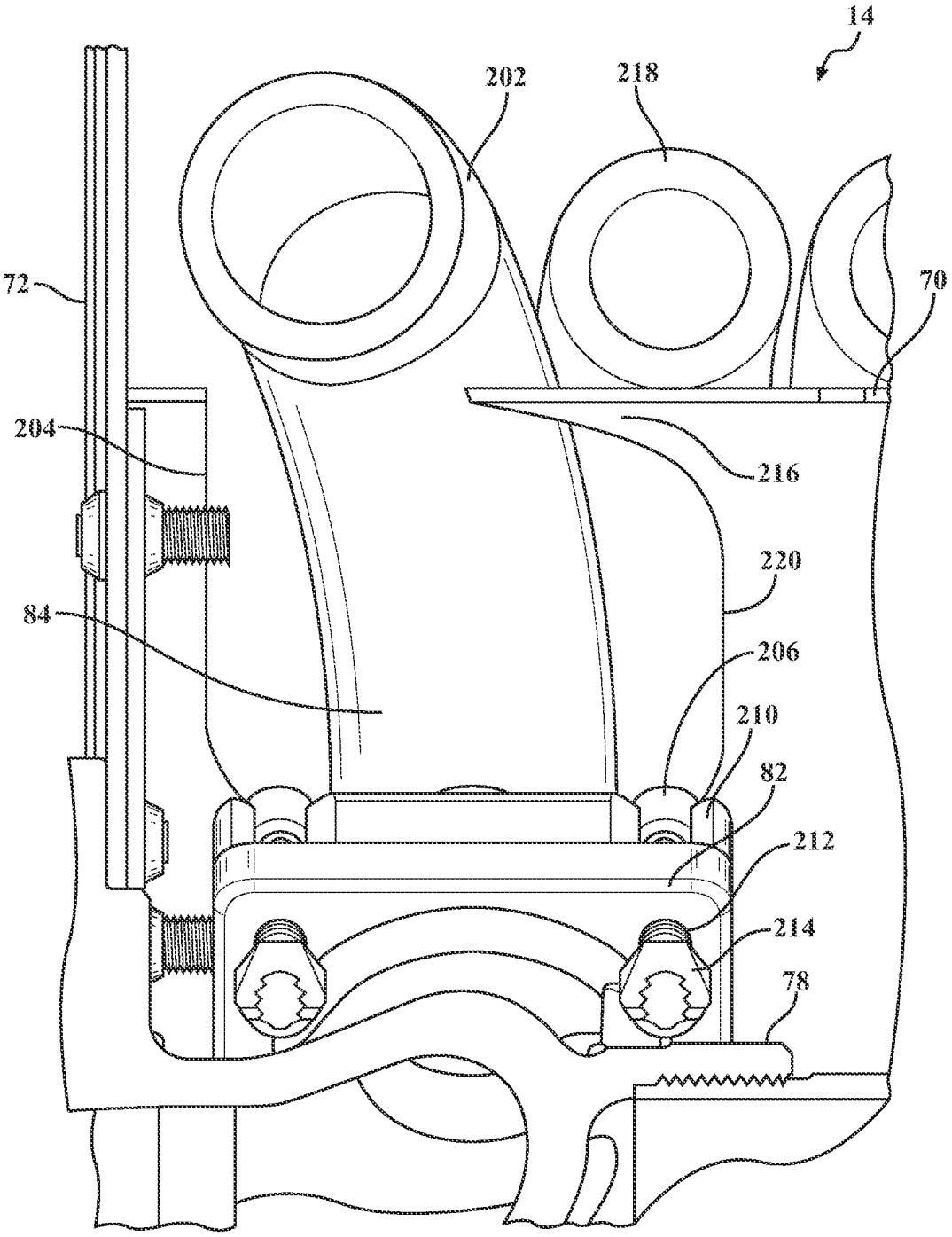
FIG. 20 shows a partial view of a portion of the spool assembly from a second perspective.

The cutout 204 extending around the drum allows the riser 84 to maintain a consistent flow path cross-section with the inlet body 78 and the hose 202. The riser 84 can also avoid a sharp curve to redirect the fluid flow between the inlet body 78 and the hose 202 without extending away from the surface of the drum 70 into the space for winding the hose 202. The cutout 204 is arranged with a lobe 216 to prevent adjacent wraps of the hose from moving into the cutout 204 and contacting edges of the cutout 204 which are potentially sharp, or which may pinch the hose 202 and prevent smooth unwinding or cause damage to the hose 202 surface. The lobe 216 may be integral with the drum 70 and formed from an irregular shape of the cutout 204. The lobe 216 is illustrated in FIG. 20, which is a partial cutaway view of the spool assembly 14 through the area of the lobe 216. The hose 202 is illustrated with wrap 218 adjacent the riser 84. The lobe 216 extends under the wrap 218 where the cutout 204 would otherwise allow the wrap 218 to fall between the riser 84 and the edge 220 of drum 70 if the edge 220 continued straight. The lobe 216 protects the hose 202 from falling under the riser 84 or contacting the edge 220 of the cutout 204 while allowing the cutout 204 to extend around the drum 70 far enough to allow the inlet body 78 to be mounted in two different orientations for top-wind and bottom-wind applications with either left-handed or right-handed risers.

The hose reel assembly 10 includes the motor assembly 18 that is controlled by a programmable controller 222, illustrated in the schematic shown in FIG. 21. The programmable controller 222 processes pre-defined commands to, for example, output pulse width modulated signals to the motor 56 to control the speed and direction of the motor 56 operation. The controller 222 may include or be in communication with a processor and a data storage device or memory. The controller 222 may be integrated to the motor assembly 18. The controller 222 may be supported on the frame assembly 12. The controller 222 may be located remote from the hose reel assembly 10. For example, where the hose reel assembly 10 is mounted to a rear or a side area of a vehicle, the controller 222 may be located in a passenger cab of the vehicle. The controller 222 may in communication with or be integrated into a control system of the vehicle having a processor and a memory or storage device. The controller 222 may be in communication with vehicle control systems providing information on the status of vehicle's operation.

The controller 222 may include or be in communication with stored data associated with or representing the configuration of the specific hose reel assembly 10 with which the controller is associated. Such data may include dimensional data, such as spool length, drum diameter, hose diameter, hose length, winding direction, unwinding direction, number of hose wraps per layer. Alternatively, the controller 222 may contain information necessary to look up or calculate the number of hose wraps per layer, based on hose length, hose diameter, spool length, and drum diameter. The controller 222 may also store information representing motor operation required to maintain a constant linear speed of the hose during a winding operation as the effective spool diameter changes when the hose is wound first on the drum 70 and thereafter on preceding layers of hose wraps. The controller 222 may include multiple user-selectable linear hose speeds for winding the hose 202 onto the hose reel assembly 10. For example, the rewind speed may be adjustable between about 1.5 miles per hour at a minimum to about 3.5 miles per hour at a maximum, although other ranges are possible. The rewind speed refers to the rate at which hose end travels over a linear distance during the rewind operation. The rewind speed may be adjustable in discrete increments of, for example, about 0.25 mph, 0.5 mph, or other interval, between a minimum rate and a maximum rate.

The programmable controller 222 is in bidirectional data communication with an input device 224, which may be remote from the programmable controller 222. The input device 224 may be in wired or wireless data communication with the controller 222 using conventional data transmission protocols. The input device 224 may allow a user to provide user input in the form of commands to the controller 222 and may provide a display or other indicator to provide feedback of information from the controller 222 to the user. For example, the input device 224 may include buttons, a touchscreen, toggle switches, or the like. In some operations, such as executing a rewind operation, the controller may require the user to provide a continuous input to the input device. For example, to perform a rewind operation, the user may press and hold a rewind button to operate the hose reel assembly 10 to rewind a hose on to the spool assembly 14.

The input device 224 may allow the user to input the data associated with or representing the configuration of the specific hose reel assembly 10 with which the controller is associated. That is, a user may program into the controller 222 parameter data one or more of spool length, drum diameter, hose diameter, hose length, winding direction, unwinding direction, number of hose wraps per layer.

A hose, such as hose 202, being wound onto the spool assembly 14, starts at the riser 84, near the reel end 72. As the spool assembly 14 rotates, the hose 202 continues to coil in a helical pattern with a pitch approximately equal to the hose diameter, around the drum 70 until the coil reaches the opposite reel end 74. The nominal number of coils of hose 202 that makes up a layer on a drum of a given length is equal to the length of the drum divided by the hose diameter minus one half coil. After reaching the reel end 74, the hose 202 transitions to start coiling a new layer over top the preceding coil and accumulate hose in the opposite direction compared with the preceding coil. For a spool assembly 14, where the reel ends 72, 74 are substantially perpendicular to the axis of the drum 70, the number of wraps or coils per layer remains constant for a given hose diameter.

Upon starting a new layer, the motor speed changes the rate of rotation of the spool assembly 14 in order to maintain a constant linear speed of the hose 202 being wound onto the spool assembly 14. A sensor 226 generates a signal or information associated with the motion of the spool assembly 14 and is in communication with the controller 222. The sensor 226 may communicate with the controller 222 via sensor cable 227. In one example, the sensor 226 is an electromagnetic sensor that generates a voltage high output when a target is within a sensing window and otherwise remains voltage low when no target is sensed. The sensor 226 may be a component of a sensor assembly 28.

The sensor assembly 28 is illustrated in greater detail in FIG. 22. The sensor 226 is disposed in a sensor body 228. The sensor body 228 may be made of a molded material, such as a molded plastic. The sensor body 228 may be formed of a non-conductive material that does not interfere with the sensor 226 sensing the motion of the spool assembly 14. A conduit 234 may extend from the sensor body 228 to protect the sensor cable 227 between the sensor 226 and the controller 222. The sensor body 228 may be supported on the frame 30 by a bracket 230. In one example, the sensor body 228 is secured to the bracket 230 via fasteners 232. The bracket 230 may be secured to the frame 30 via fasteners 236, 238. In alternative examples, the sensor 226 may be directly supported on the frame 30, or else may be supported as part of the motor assembly 18. In another alternative example, the bracket 230 may be formed integrally with the sensor body 228. In one example, the sensor cable 227 may be a shielded cable which incorporates a protective aspect so that the conduit 234 may be omitted.

The sensor 226 is securely positioned relative to the spool assembly 14 so that the sensing window of the sensor 226 includes the fasteners 76 that secure the reel end 72 to the drum 70. As the spool assembly 14 rotates each fastener 76 sequentially enters the sensing window of the sensor 226 triggering the sensor to output a voltage high signal to the controller. As illustrated, the hose reel assembly 10 includes eight fasteners 76, providing a signal output from the sensor 226 with each 45° of rotation. In alternative examples, more or fewer sensor targets may be provided and may be arranged as fasteners used in the assembly of the spool assembly or provided as separate sensor targets specifically. The sensor signal can be used to track the revolutions of the spool assembly 14 so that the controller 222 can adjust the motor 56 speed at the completion of each layer of hose 202 to maintain a constant linear speed of the hose 202 as it is being wound onto the spool assembly 14.

The hose reel assembly 10 may provide a power-out assist operation. This operation mode allows the hose reel assembly 10 to reduce the required effort of a user to extract the hose 202 from the hose reel assembly 10 without the motor 56 actively driving the spool assembly 14 to unwind the hose 202. During a power-out assist the controller 222 provides a level of current to the motor 56 that has been empirically determined to be at least slightly below the threshold necessary to overcome static friction and to maintain a level of current to the motor 56 that has been empirically determined to be at least slightly below the threshold necessary to overcome dynamic friction of the hose reel assembly 10. Thus, the power-out assist mode reduces the amount of force required for a user to extract the hose from the reel but does not actively drive the hose off the reel assembly.

Each of the motor assembly 18, the spool assembly 14, and the level wind device 16 contribute friction against the rotation generated by the motor 56. The hose reel assembly 10 as constructed may vary as to the exact amount of friction generated, but which can be measured. The controller 222 may include a variable setting dependent on the amount of friction present in the assembly in order to modulate the level of current to provide to the motor 56 during a power-out assist operation. For example, the level of current supplied during power-out assist may be about 10%, that is between 5% and 15%, below the level of current needed to overcome static or dynamic friction. Alternatively, the level of current supplied may be about 25%, that is between 20% to 25%, below the level of current needed to overcome static or dynamic friction. In other examples, a different amount of current may be suppled during static conditions than during dynamic conditions.

Figure 23:
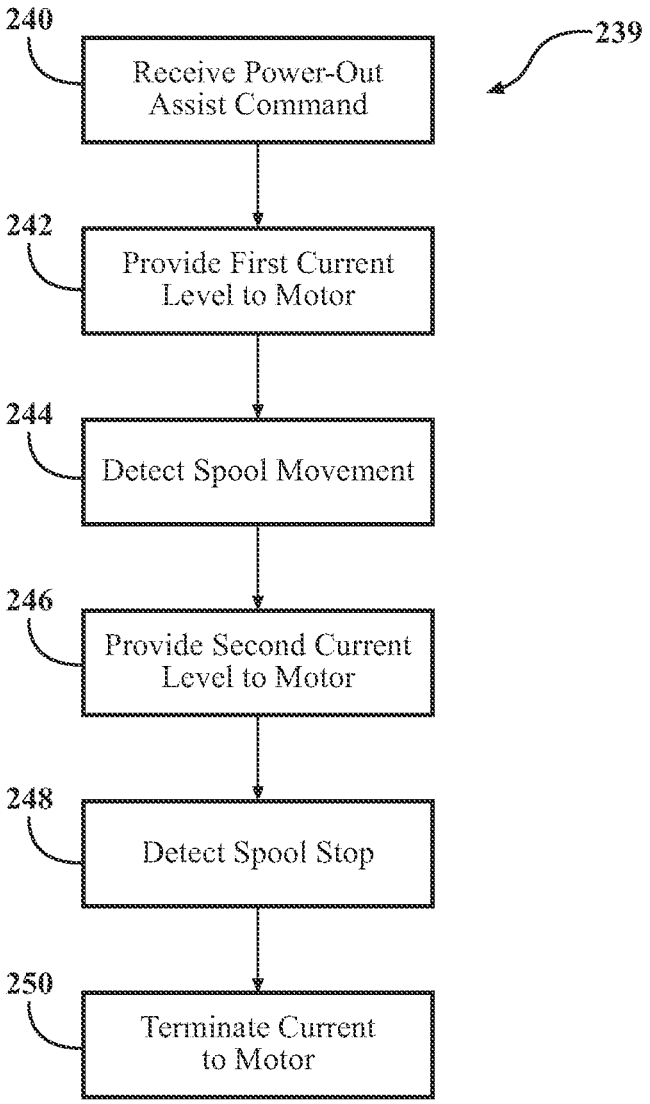
FIG. 23 shows the steps of a method for operating a hose reel assembly.

In one example of a method 239 of operating a power-out assist, as illustrated in FIG. 23, the controller 222 receives an input from the remote input device 224 to set the hose reel assembly 10 in power-out assist mode, for example, by a user pressing a button or otherwise entering a selection on the remote input device 224, at step 240. The controller 222 may execute the power-out assist operation only while the button remains pressed, and if released terminates the operation. The controller 222 at step 242 provides power to the motor 56 at a level of about 25% below the level of current needed to overcome static friction as was determined empirically after the hose reel assembly 10 was manufactured. The controller 222 receives a voltage high signal from the sensor 226 within a window to time following the command input at step 244, indicating that the spool assembly 14 is rotating in the unwinding direction as the user pulls on the hose to overcome the remaining static friction forces. The controller 222 adjusts the current level to the motor 56 to be 15% below the level of current needed to overcome dynamic friction, at step 246, as was previously determined empirically. This power level may be referred to as the drive level. The controller 222 no longer receives a voltage high signal from the sensor 226 within a window of time subsequent to the preceding sensor signal at step 248 and in this way detects that the spool is no longer rotating. Once the spool is no longer rotating, for example, because the user has ceased applying a pulling force to the hose, or because the hose has been fully unwound from the hose reel, the controller 222 terminates the power supplied to the motor 56 at step 250.

The controller 222 may terminate power to the motor 56 when the user releases the button for providing the power-out assist command, for example, on the remote device 224. The controller 222 may be configured to require a continuous input from the remote device 224 in order to energize the motor 56. In the absence of a user command, the controller may place the motor into an automatic brake condition which applies a high resistance to the free spinning of the motor 56. This may be accomplished by DC injection braking, or by regenerative braking. Braking may be applied to the motor 56, for example, while the vehicle is powered on and no command is received from the input device 224. The braking may be disabled if vehicle is powered off or power from the vehicle is removed from the hose reel assembly 10.

During the power-out assist operation mode, the controller 222 does not drive the reel rotation at a non-zero rate in order to start the spool assembly 14 rotating in the unwind direction, and, during unwinding, the controller 222 does not maintain rotation once the user stops pulling the hose 202 from the hose reel assembly 10. The level of power provided by the controller 222 to the motor is always less than the amount needed to overcome the dynamic friction of the system so that if the user's pulling force drops to zero, or below a minimum non-zero threshold, the spool assembly 14 will stop rotating in the unwind direction.

Figure 24:
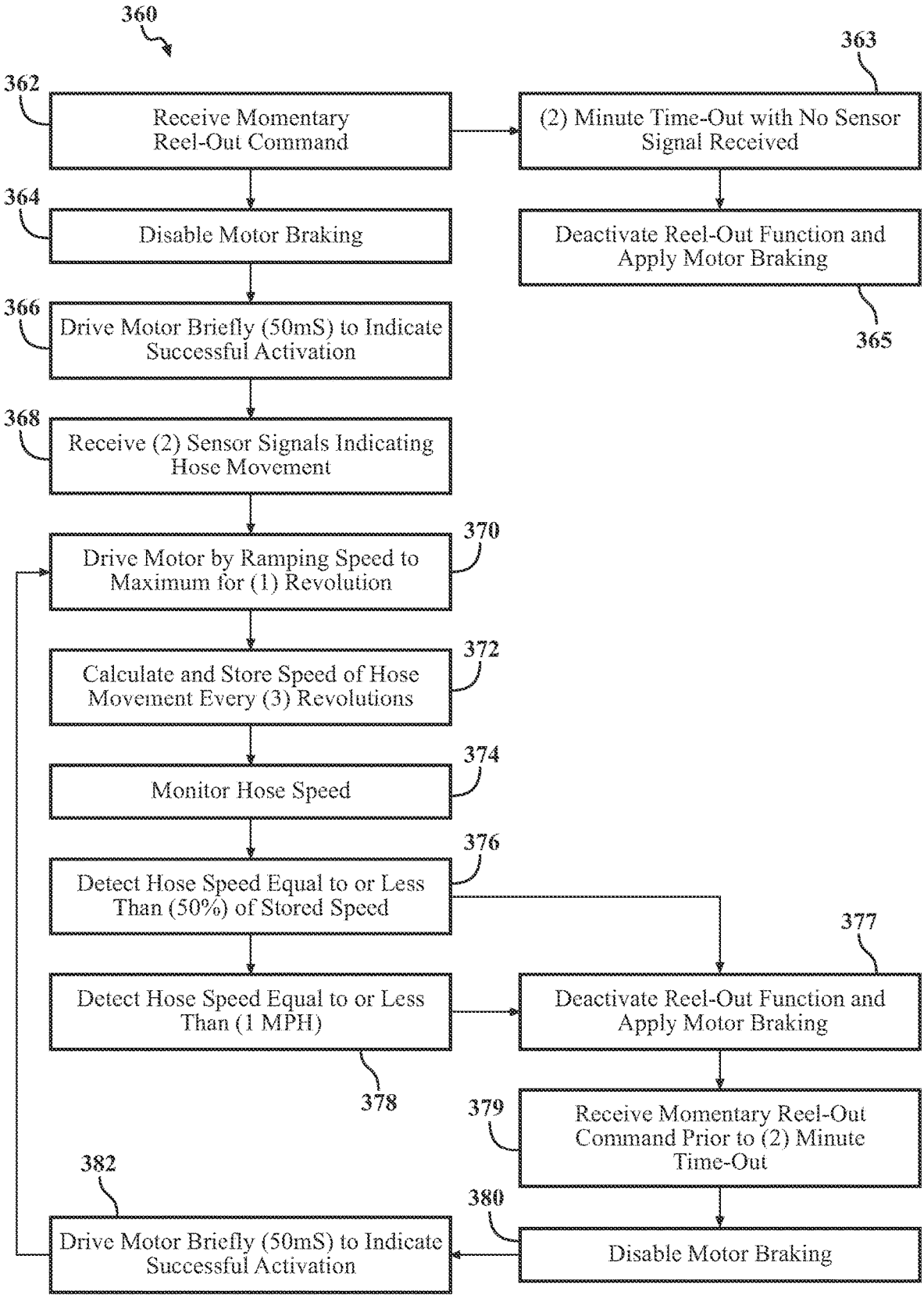
FIG. 24 shows the steps of a second method for operating a hose reel assembly.

In another example, the hose reel assembly 10 may provide a power-out assist operation where the user is not required to maintain a continuous input from the remote device 224. In certain implementations, the hose reel assembly 10 may be used with hoses of great length and weight, for example, hoses about 150 feet in length weighing in excess of 100 pounds. Therefore, it may be desirable to allow an operator to maintain both hands on the hose while unwinding the hose rather than requiring one hand to provide a continuous input. FIG. 24 illustrates the steps of a method 360 to provide a hands-free power-out assist operation.

In a first step 362, the controller 222 receives a momentary reel-out command, for example as an input from the remote input device 224 by a user pressing a button or otherwise entering a selection, e.g., via voice or gesture command. The controller 222 disables motor braking in response to receiving the command at step 364 and drives the motor briefly to indicate successful activation at step 366. In one example, the controller 222 powers the motor in the unwind direction for a period of 50 milliseconds to indicate to the user a successful activation of the hands-free reel-out operation. The controller may power the motor during this time to a power level of 50% of the drive level. In other alternatives, the controller may power the motor greater than 50% of the drive level, up to 75% or up to 100% of the drive level. This motor operation is audible to the user and may loosen tension on the hose but the duration of power supply to the motor is not sufficient to drive the spool assembly to unwind the hose.

Following the indication of successful activation in step 366, the user may begin pulling the hose off the reel. With the motor braking deactivated in step 364 and the hose loosened by the momentary motor actuation in step 366, the user is able to pull the hose from the reel with minimal effort. The controller 222 monitors the sensor signal for a window of time following the momentary reel-out command. The controller 222 monitors the sensor signal, for example for two minutes, at step 363 and if the user does not begin pulling out the hose, no further sensor signal will be received to indicate hose movement. The controller 222 then deactivates the reel-out function and applies motor braking to the spool assembly at step 365.

Where the user has begun pulling out the hose, the controller 222 receives sensor signals indicating hose movement. The controller 222 may count a threshold number of sensor signals, for example two sensor signals, to indicate hose movement and continue the reel out operation, in step 368. In other examples, more or fewer sensor signals, or windows of time of a predetermined length may be used to indicate hose movement. At step 370, following receipt of sensor signals indicating hose movement, the controller supplies increasing power to drive the motor up to a power level corresponding to the drive level as described above. The motor power may be ramped up in a linear fashion over the course of, for example, one revolution of the spool assembly 14. While the reel out operation continues, at step 372, the controller 222 monitors the sensor signal to calculate and store the speed of the hose movement averaged over the course of, for example, three revolutions of the spool assembly 14. In other examples, the hose speed may be calculated for each rotation, or averaged over five rotations of the spool assembly. It other examples, the controller 222 may calculate the hose speed over a window of time rather than angular range of the spool assembly. The controller continues to monitor hose speed, at step 374, until the controller determines that the hose speed is equal to or less than half of the previously stored hose speed, at step 376, or else determines that the hose speed has been equal to or less than a threshold speed, such as 1 mile per hour of linear hose speed, at step 378. In response to either speed reduction determination, the controller 222 deactivates the reel-out function and applies motor braking, at step 377. The controller 222 may thereafter receive a further momentary reel-out command prior to a two-minute timeout window, at step 379, which will cause the controller 222 to disable the motor braking, at step 380, drive the motor briefly to indicate successful activation of the reel-out function, at step 382, and then resume powering the motor up to the drive level at step 370 and continue monitoring the hose speed, as in step 372.

The above description has been provided using the common names for structures recognized in the relevant industry. These structural components have well understood individual meanings, including understood material make-ups, and methods for manufacturing, assembling, and operating. For example, for petrochemical applications, it may be desirable to form structural component from metal materials. For other fluid applications, such as clean water applications, structural components may be formed of plastic, such as PVC. Similarly, components like springs, bearings, bolts, and seals have recognized meaning in the industry, including recognized suitable materials and methods for manufacturing, assembling, and operating, depending on the intended application.

The present disclosure is provided in an illustrative manner, and it is to be understood that the terminology which has been used is intended to be in the nature of words of description rather than of limitation. Moreover, words of degree or approximation, such as substantially or about, are reflective of real world conditions that do not meet mathematical perfection and are understood to permit deviation consistent with tolerances and allowanced customary in the relevant technology. Similarly, words of direction, such as above or below, or distinction, such as first or second, are used in reference to a customary implementation contemplated by the descriptive examples as would be understood by one of skill in the art, and are not intended to be limiting. Where an example is illustrated in one orientation, an opposite orientation should be readily understood as consistent and within the scope of the disclosure unless specifically described as a necessary arrangement. Likewise, reference to a first and a second merely distinguishes between two examples without connoting a particular order, precedence or importance, nor does referencing a first require the presence of a second. Many modifications and variations of the present disclosure are possible in light of the above teaching, and may be practiced other than as specifically described.

What is claimed is:

1. A hose reel comprising:

a frame;

a spool supported on the frame for rotation relative to the frame to support a hose thereon;

a motor supported on the frame to drive a rotation of the spool;

a level wind device supported on the frame, the level wind device comprising a carriage assembly for back-and-forth translation across a length of the spool to guide the hose during winding and unwinding to and from the spool, the level wind device including a gear box to receive the rotation of the spool and having an engaged configuration and a disengaged configuration; and wherein translation of the carriage assembly is selectively linked to the rotation of the spool via the gear box, the gear box comprising a disengagement clutch for selectively decoupling the translation of the carriage assembly from the rotation of the spool, and in the engaged configuration, the gear box transmits the rotation from the spool to the carriage assembly and in the disengaged configuration, the spool and the carriage assembly move independently.

2. The hose reel of claim 1, wherein the spool comprises:

a drum extending between a first reel end and a second reel end, the drum defining an interior;

an inlet body having a first flange and a second flange, the first flange disposed adjacent the first reel end opposite the drum, and the second flange disposed within the interior of the drum, the inlet body extending through the first reel end; and a riser having a flange at a first end for connecting to the inlet body in the interior of the drum and a hose connection at a second end, opposite the first end, for connecting to a hose, the riser extending from the interior of the drum, wherein the second end of the riser is disposed nearer the first reel end than the first end of the riser.

3. A hose reel comprising:

a frame;

a spool supported on the frame for rotation relative to the frame;

a motor supported on the frame to drive a rotation of the spool;

a level wind device supported on the frame, the level wind device comprising a carriage assembly for back-and-forth translation;

wherein translation of the carriage assembly is selectively linked to the rotation of the spool via a gear box, the gear box comprising a disengagement clutch for selectively decoupling the translation of the carriage assembly from the rotation of the spool; and wherein the level wind device comprises a roller chain sprocket having at least one bore, the gear box comprises a level wind gear engaged with the spool, wherein rotation of the level wind gear rotates a clutch shaft, the clutch shaft having at least one recess, a clutch pin disposed in the recess for slidable translation within the recess along the clutch shaft and retained to the clutch shaft by a clutch bushing for movement therewith, the clutch bushing movable between a first position wherein the clutch pin extends into the bore of the roller chain sprocket and the rotation of the roller chain sprocket is linked to the level wind gear, and a second position where the clutch pin is withdrawn from the roller chain sprocket and the rotation of the roller chain sprocket is decoupled from the level wind gear.

4. The hose reel of claim 3, wherein the gear box further comprises a spring biasing the clutch bushing to urge the clutch bushing in the direction of the first position.

5. The hose reel of claim 4, wherein the gear box comprises a clutch yoke extending from the clutch bushing, the gear box further comprising a clutch rod secured to the clutch yoke, the clutch rod slidably retained to the gear box for translational motion parallel to the clutch shaft.

6. A hose reel comprising:

a frame;

a spool supported on the frame for rotation relative to the frame;

a motor supported on the frame to drive a rotation of the spool;

a level wind device supported on the frame, the level wind device comprising a carriage assembly for back-and-forth translation;

wherein translation of the carriage assembly is selectively linked to the rotation of the spool via a gear box, the gear box comprising a disengagement clutch for selectively decoupling the translation of the carriage assembly from the rotation of the spool; and wherein the level wind device comprises an alignment guide and a gimbal guide supported on the carriage assembly.

7. The hose reel of claim 6, wherein the alignment guide comprises a roller matrix, the roller matrix comprising a first pair of proximal roller stacks and a second pair of distal roller stacks.

8. The hose reel of claim 7, wherein the respective ones of the first pair of proximal roller stacks and the second pair of distal roller stacks, each comprise a frustoconical roller and a cylindrical roller arranged for independent rotation about a common axis.

9. The hose reel of claim 8, wherein the first pair of proximal roller stacks is arranged between the spool and the second pair of distal roller stacks, and wherein each of the respective ones of the first pair of proximal roller stacks comprises the cylindrical roller arranged vertically above the frustoconical roller and wherein each of the respective ones of the second pair of distal roller stacks comprise the frustoconical roller arranged vertically above the cylindrical roller.

10. The hose reel of claim 6, wherein the gimbal guide comprises a clevis supported on the carriage assembly, the clevis is selectively positionable between a first storage position and a second deployed position, the clevis comprising a latch arranged to releasably retain the clevis in the second deployed position.

11. The hose reel of claim 10, wherein the gimbal guide comprises a yoke supported on the clevis for rotation relative to the clevis about a first axis; and a fork supported on the yoke for rotation relative to the yoke about a second axis, the second axis being substantially perpendicular to the first axis, the fork supporting a roller for rotation relative to the fork.

12. The hose reel of claim 11, wherein the clevis comprises a pair of bosses arranged to limit the yoke for rotation in a range of less than 180° relative to the clevis.

13. The hose reel of claim 11, wherein the fork is limited by the yoke for rotation in a range of less than 45° relative to the yoke.

14. A hose reel comprising:

a frame;

a spool supported on the frame for rotation relative to the frame;

a motor supported on the frame to drive a rotation of the spool;

a level wind device supported on the frame, the level wind device comprising a carriage assembly for back-and-forth translation;

wherein translation of the carriage assembly is selectively linked to the rotation of the spool via a gear box, the gear box comprising a disengagement clutch for selectively decoupling the translation of the carriage assembly from the rotation of the spool; and wherein the spool includes a plurality of gear segments, each gear segment comprising a first interlocking feature at a first end and a second interlocking feature at a second end; the first interlocking feature of one of the plurality of gear segments engaging with the second interlocking feature of an adjacent one of the plurality of gear segments; the interlocking gear segments combining to form a ring gear.

15. A hose reel comprising:

a frame;

a spool supported on the frame for rotation relative to the frame;

a motor supported on the frame to drive a rotation of the spool;

a level wind device supported on the frame, the level wind device comprising a carriage assembly for back-and-forth translation;

wherein translation of the carriage assembly is selectively linked to the rotation of the spool via a gear box, the gear box comprising a disengagement clutch for selectively decoupling the translation of the carriage assembly from the rotation of the spool; and wherein the frame comprises a motor mount, the motor mount comprising a plurality of keyhole slots for receiving a head of a fastener, the motor mount further comprising a stud retainer, the stud retainer comprising a plurality of biasing arms covering a backside of each of the plurality of keyhole slots.

16. A hose reel comprising:

a frame;

a spool supported on the frame for rotation relative to the frame;

a motor supported on the frame to drive a rotation of the spool;

a level wind device supported on the frame, the level wind device comprising a carriage assembly for back-and-forth translation;

wherein translation of the carriage assembly is selectively linked to the rotation of the spool via a gear box, the gear box comprising a disengagement clutch for selectively decoupling the translation of the carriage assembly from the rotation of the spool; and wherein the spool comprises:

a drum extending between a first reel end and a second reel end, the drum defining an interior, wherein the drum comprises a cutout for accessing an interior of the drum;

an inlet body having a first flange and a second flange, the inlet body disposed at least partially within an interior of the drum; and a riser having a flange at a first end for connecting to the inlet body in in the interior of the drum and a hose connection at a second end, opposite the first end, for connecting to a hose, the riser extending from the interior of the drum through the cutout, wherein the cutout further defines a protective lobe that extends between at least a portion of the riser and the interior of the drum.

17. A hose reel system comprising:

a frame, a spool supported on the frame for rotation relative to the frame;

a motor supported on the frame to drive a rotation of the spool;

a sensor supported on the frame and arranged to generate a signal based on rotation of the spool; and a controller, the controller in communication with the sensor and the motor, the controller comprising a processor and a memory device storing program instructions, that when executed cause the controller to:

receive a power-out assist command;

provide a first current level to the motor, the first current level being less than a threshold current level to overcome a static friction of the motor and spool;

detect rotation of the spool based on the signal generated by the sensor;

provide a second current level to the motor in response to detecting the rotation of the spool, the second current level being less than a threshold current level to overcome a dynamic friction of the motor and spool;

detect a rotation stop of the spool based on an absence of the signal generated by the sensor; and terminate the current to the motor in response to detecting the rotation stop of the spool.

18. The hose reel system of claim 17, further comprising a remote input device in communication with the controller, the remote input device operable to receive a user input, generate a power-out assist command based on the user input, and the remote input device operable to transmit the power-out assist command to the controller.

19. The hose reel system of claim 17, wherein the first current level is at least 10% below the threshold current level to overcome static; and wherein the second current level is at least 10% below the threshold current level to overcome dynamic friction.

20. A hose reel system comprising:

a frame comprising a motor mount, wherein the motor mount comprises a plurality of keyhole slots for receiving a head of a fastener, the motor mount further comprising a stud retainer, the stud retainer having a biasing arm covering a backside of each of the plurality of keyhole slots;

a spool supported on the frame for rotation relative to the frame, the spool comprising a drum extending between a first reel end and a second reel end, the drum defining an interior, wherein the drum comprises a cutout for accessing an interior of the drum;

an inlet body having a first flange and a second flange, the first flange disposed adjacent the first reel end opposite the drum, and the second flange disposed within the interior of the drum, the inlet body extending through the first reel end; and a riser having a flange at a first end for connecting to the inlet body in the interior of the drum and a hose connection at a second end, opposite the first end, for connecting to a hose, the riser extending from the interior of the drum through the cutout, wherein the second end of the riser is disposed nearer the first reel end than the first end of the riser; and wherein the cutout further defines a protective lobe that extends between at least a portion of the riser and the interior of the drum; and a motor mounted to the motor mount to drive a rotation of the spool, the motor comprising a motor gear; and a level wind device supported on the frame, the level wind device comprising a carriage assembly for back-and-forth translation;

wherein translation of the carriage assembly is selectively linked to the rotation of the spool via a gear box, the gear box comprising a disengagement clutch for selectively decoupling the translation of the carriage assembly from the rotation of the spool; and wherein the spool includes a plurality of gear segments, each gear segment comprising a first interlocking feature at a first end and a second interlocking feature at a second end; the first interlocking feature of one of the plurality of gear segments engaging with the second interlocking feature of an adjacent one of the plurality of gear segments, the interlocking gear segments combining to form a ring gear.

* * * * *